US006694687B2

(12) United States Patent
Elmer

(10) Patent No.: US 6,694,687 B2
(45) Date of Patent: Feb. 24, 2004

(54) BUILDING GLASS FACADE AND A CLAMP FITTING FOR MOUNTING A GLASS PLATE IN A GLASS FACADE OF A BUILDING

(75) Inventor: Hubert Elmer, Thaur (AT)

(73) Assignee: DORMA GmbH + Co. KG, Ennepetel (DE)

( * ) Notice: Subject to any disclaimer, the term of this patent is extended or adjusted under 35 U.S.C. 154(b) by 0 days.

(21) Appl. No.: 10/163,163

(22) Filed: Jun. 5, 2002

(65) Prior Publication Data

US 2003/0154671 A1 Aug. 21, 2003

Related U.S. Application Data

(63) Continuation-in-part of application No. PCT/EP00/12151, filed on Dec. 4, 2000.

(30) Foreign Application Priority Data

Dec. 6, 1999 (DE) ..... 199 58 622

(51) Int. Cl.[7] ..... E04B 5/46

(52) U.S. Cl. ..... 52/308; 52/235; 52/506.05; 52/509; 403/367; 403/368; 403/369; 403/370; 403/374.1; 403/374.3

(58) Field of Search ..... 52/235, 506.05, 52/509; 403/367, 368, 369, 370, 374.1, 374.3

(56) References Cited

U.S. PATENT DOCUMENTS

| | | | | | |
|---|---|---|---|---|---|
| 3,382,630 | A | * | 5/1968 | Chivers | 52/208 |
| 4,680,206 | A | * | 7/1987 | Yoxon et al. | 428/34 |
| 5,525,001 | A | * | 6/1996 | Perkins | 403/157 |
| 5,540,514 | A | * | 7/1996 | Demars et al. | 403/388 |
| 6,105,319 | A | * | 8/2000 | Brunt | 52/204.593 |
| 6,131,346 | A | * | 10/2000 | Kordes | 52/235 |
| 6,254,397 | B1 | * | 7/2001 | Elmer | 439/6 |
| 6,442,911 | B2 | * | 9/2002 | Elmer et al. | 52/506.01 |
| 6,519,903 | B1 | * | 2/2003 | Dirisamer et al. | 52/235 |

FOREIGN PATENT DOCUMENTS

| | | |
|---|---|---|
| DE | 1931089 | 2/1970 |
| DE | 4400979 | 7/1995 |
| DE | 4445724 | 6/1996 |
| DE | 19519527 | 11/1996 |
| DE | 19536331 | 4/1997 |
| EP | 0784129 | 7/1997 |
| WO | 9963193 | 12/1999 |

* cited by examiner

*Primary Examiner*—Carl D. Friedman
*Assistant Examiner*—Steve Varner
(74) *Attorney, Agent, or Firm*—Nils H. Ljungman & Associates

(57) ABSTRACT

There is now provided a building glass facade of a building comprising a plurality of glass plates each of which is secured by clamp fittings for a glass plate, with each clamp fitting comprising two clamp elements that clamp the glass plate between them and also comprising an articulated support of the clamp fitting on a fastening device, whereby a first articulated arrangement comprises a substantially permanently elastic element that is disposed on one clamp element. There is also provided a second articulated arrangement that has two plano-concave lenses that face each other with their spherical surfaces, between which the bolt head of a pendulum bolt with corresponding concave complementary surfaces is guided.

20 Claims, 9 Drawing Sheets

BUILDING GLASS FACADE AND A CLAMP FITTING FOR MOUNTING A GLASS PLATE IN A GLASS FACADE OF A BUILDING

CONTINUING APPLICATION DATA

This application is a Continuation-in-Part application of International Application No. PCT/EP00/12151, filed on Dec. 4, 2000, and claiming priority from Federal Republic of Germany Patent Application No. 199 58 622.5, filed on Dec. 6, 1999. International Application No. PCT/EP00/12151 was pending as of the filing date of this application. The United States was an elected state in International Application No. PCT/EP00/12151.

BACKGROUND OF THE INVENTION

1. Field of the Invention

The present invention relates in one aspect to a building glass facade and a clamp fitting for mounting a glass plate in a glass facade of a building.

2. Background Information

Federal Republic of Germany Patent No. 195 19 527 A, filed on May 27, 1995, and issued on Nov. 18, 1999, describes a device in which a carrier which is connected with the building-side mounting is supported on a clamp element on the inside of the building. The support is provided by means of a bearing head of the carrier, which bearing head is elastically mounted in a bearing chamber of the clamp element which is flexible in the axial direction of the carrier, whereby the bearing head is also mounted with lateral clearance in the bearing chamber, to make possible a displacement of the carrier or of its bearing head parallel to the plane of the glass plate when wind pressure is exerted. The elastic flexibility of the bearing head is effected by belleville spring washers or a substantially permanently elastic material, the location of which in the bearing chamber continuously exerts a restoring force on the carrier or the glass pane in the sense of positioning the carrier orthogonally with respect to the glass pane, which ultimately results in the introduction of stresses into the glass pane. In addition, large tolerances between the boring in the glass pane and the connection point on the building-side mounting cannot be compensated.

Federal Republic of Germany DE-OS No. 44 00 979 A1, filed on Jan. 14, 1994, corresponding to EP 0663 507 B1 of Sep. 2, 1998, likewise discloses a device in which the clamp element on the inside of the building (receptacle bearing) has a spherical surface on the lateral surface that faces the mounting, against which spherical surface an equalizing part is in contact with a complementary surface of a universal ball joint. The clamp element has a through-hole to receive the clamp screw that connects the clamp elements and a retaining screw that runs through the equalizing part and is inserted into the clamp element. With this device of the prior art, manufacturing tolerances between the boring in a glass pane and a sub-structure (mounting) can be equalized. There is no elastic support of the pane on the mounting after assembly and installation.

A similar device is described in Federal Republic of Germany DE-OS No. 44 45 724 A1, filed on Dec. 21, 1994, corresponding to GB published patent application No. 2 296 264 A published on Jun. 26, 1996, in which the clamp element on the inside of the building has, on its lateral surface facing the mounting, a spherical surface against which a pivot bearing of a fastening part is in contact by means of its complementary surface, whereby the pivot bearing is held in a union nut with lateral clearance. After assembly and installation, the pane can no longer move relative to the fastening part.

European Patent Specification EP 0 784 129 A1 of Sep. 6, 2000, also describes a support of a fastening bolt on a mounting, in which a plate of a mounting is fastened between two plano-convex lenses which are in contact by means of their plane surfaces directly against the plate, whereby one lens is in contact with its convex surface against a clamp element on the inside of the building and the other lens is in contact indirectly with a nut that holds the fastening bolt.

The fastening devices of the prior art do not meet the requirements for the fastening of highly sensitive glass plates, such as silicon plates for the photovoltaic generation of electricity. Even at low wind pressure or in the event of relatively small deformations that are caused by the introduction of heat, the silicon elements break and the glass plate no longer performs the desired function. A rather large tolerance equalization is also necessary if, for example, a plurality of glass wall segments that are adjacent to one another essentially orthogonally or at an angle to one another are to be connected to one another by means of connecting bridges. In this case, in addition to the capability of equalizing rather large tolerances, the connection should introduce the lowest possible level of stresses into the individual glass wall segments via the clamp fittings which are connected to one another via the connecting bridge.

All of the aforementioned patent applications cited above are hereby incorporated by reference as if set forth in their entirety herein.

OBJECTS OF THE INVENTION

One object of the present invention is to improve a clamp fitting of the type described above so that on one hand, a stress-free adjustment of the clamp fitting is possible during assembly and installation, even if there are relatively large manufacturing tolerances, and so that on the other hand, after assembly and installation, sufficient elasticity remains between the clamp fitting and the glass plate to absorb wind pressure, thermal stresses or mechanical loads without introducing stresses into the glass plate from the clamp fittings and thus from the fastening device.

It is also an object of the present invention to provide a clamp fitting for a glass plate that has at least two adjustable pivots to accommodate manufacturing and assembly tolerances.

It is an additional object of the present invention to provide a clamp fitting for a glass plate that, after assembly, has resiliency to accommodate thermal stresses and wind loads without stressing the glass plate.

It is a further object of the present invention to provide a clamp fitting for a glass plate that has a compact configuration.

It is yet an additional object of the present invention to provide a clamp fitting for a glass plate that provides angular adjustment through large angles, in order to accommodate large manufacturing and construction tolerances.

It is another object of the present invention to provide a clamp fitting for a glass plate that includes a substantially permanently elastic spring member to protect the glass plate from stresses due to wind loads and thermal effects.

SUMMARY OF THE INVENTION

The invention in one aspect teaches that these objects can be achieved by a building glass facade of a building comprising a plurality of glass elements covering at least a portion of the building, at least one of said elements comprising a glass pane, said facade comprising: at least one glass pane; said at least one glass pane comprising a first surface, a second surface opposite from said first surface, and a hole connecting said first and second surfaces; and a clamp fitting configured and disposed to secure said glass pane to protect said glass pane from thermal stresses, mechanical loads, and wind pressure; said clamp fitting comprising: a clamp assembly comprising a first clamp element and a second clamp element; said first clamp element comprising a portion passing through said hole of said at least one glass pane; said second clamp element comprising a surface facing away from said glass pane; said first clamp element and said second clamp element being configured to secure said glass pane in a clamped attitude; a bell-shaped structure comprising an interior surface; an elastic element disposed between said bell-shaped structure and said second clamp element; said elastic element comprising a surface of one of: a conical surface or a spherical surface; said interior surface of said bell-shaped structure operatively contacting said surface of said elastic element to permit adjustable biasing of said bell-shaped structure; a pivot arrangement comprising a nut member, a bolt member, a first disc element and a second disc element; said nut member operatively connecting said pivot arrangement to said bell-shaped structure; said nut member comprising a base, and a passage in said base; said bolt member comprising a shaft portion extending through said passage; said first disc element comprising a first, planar, surface and a second, concave, surface opposite said first, planar, surface of said first disc element; said first, planar, surface of said first disc element contacting said bell-shaped structure; said second disc element comprising a first, planar, surface and a second, concave, surface opposite from said first, planar, surface of said second disc element; said concave surface of said first disc element being disposed to face said concave surface of said second disc element; said first, planar, surface of said second disc element contacting said base of said nut member; a structure comprising a first portion having a first, convex surface and a second, planar surface opposite said convex surface, and said structure comprising a second portion having a first, convex surface and a second, planar surface opposite said second portion convex surface; said first portion of said structure being connected to said shaft portion of said bolt member; said first portion planar surface and said second portion planar surface being configured and disposed to permit sliding movement between said first portion and said second portions of said structure; said first portion convex surface being configured to be slidingly disposed against said second, concave, surface of said first disc element to permit pivoting movement of said pivot arrangement in at least two directions; said second portion convex surface being configured to be slidingly disposed against said second, concave, surface of said second disc element to permit pivoting movement of said pivot arrangement in at least two directions; and said clamp fitting comprising: a device configured to connect said clamp fitting to a support arrangement connected to a building.

The invention further teaches that the objects can be accomplished by a building glass facade of a building comprising a plurality of glass elements covering at least a portion of the building, at least one of said elements comprising a glass pane, said facade comprising: at least one glass pane; said at least one glass pane comprising a first surface, a second surface opposite from said first surface, and a hole connecting said first and second surfaces; and a clamp fitting configured and disposed to secure said glass pane to protect said glass pane from thermal stresses, mechanical loads, and wind pressure; said clamp fitting comprising: a clamp assembly comprising a first clamp element and a second clamp element; said first clamp element and said second clamp element being configured to secure said glass pane in a clamped attitude; a bell-shaped structure; a flexible structure disposed between said bell-shaped structure and said second clamp element and configured to permit adjustable biasing of said bell-shaped structure; a pivot arrangement comprising a bolt member, a nut member, first and second disc elements, and a structure configured and disposed to permit pivoting movement of said pivot arrangement; said first disc element comprising a concave surface; said second disc element comprising a concave surface; said pivot structure comprising a first portion comprising a convex surface; said pivot structure comprising a second portion comprising a convex surface; said first and second portions being configured and disposed to be in contact with one another to permit movement in at least two directions of said pivot arrangement; said pivot structure second portion being connected to said bolt member; said convex surface of said pivot structure first portion being configured to be slidingly disposed against said concave surface of said first disc element to permit movement in at least two directions of said pivot arrangement, and said convex surface of said pivot structure second portion being configured to be slidingly disposed against said concave surface of said second disc element to permit movement in at least two directions of said pivot arrangement; and said clamp fitting comprising: a device configured to connect said clamp fitting to a support arrangement connected to a building.

The invention also teaches that the foregoing objects can be accomplished by a clamp fitting configured to secure a glass plate to a building, said clamp fitting comprising: a clamp assembly configured to secure a glass plate in clamped attitude at a predetermined distance adjacent to a building; a first articulated arrangement operatively connected to said clamp assembly; said first articulated arrangement comprising a flexible element configured to compensate for thermal stresses, mechanical loads, and wind pressure impacting on a glass plate secured by said clamp assembly; a second articulated arrangement operatively connected to said first articulated arrangement; said second articulated arrangement comprising a first concave element, and a second concave element; each of said first and second concave elements comprising a concave surface; said concave surface of said first concave element being disposed towards said concave surface of said second concave element; said second articulated arrangement comprising a first convex portion disposed towards said first articulated arrangement, and also comprising a second convex portion disposed away from said first convex portion; said second articulated arrangement comprising a structure being connected to said first convex portion; and fastener means configured to secure said structure to a support connected to a building structure; said fastener means being connected to said structure; said first convex portion being configured to slide against said concave surface of said first concave element, and said second convex portion being configured to slide against said concave surface of said second concave element; to permit pivoting movement of said clamp assembly with respect to a building.

The invention in a further aspect teaches that the three-dimensionally articulated hinge has two plano-concave lenses with their spherical surfaces facing each other, whereby one lens is in contact with its plane surface against the cylindrical extension of the clamping bell and the other lens is in contact with its plane surface against the base of cup of the union nut, and whereby the bolt head of the pendulum bolt is guided with correspondingly convex complementary surfaces on the spherical surfaces of the lenses.

The invention in one aspect teaches that, beginning with the generic clamp fitting represented by the Applicant's internal prior art, wind pressure, thermal stresses or mechanical loads can be absorbed by the elastic support of the clamping bell on the clamp element, because even after assembly and installation, a relative movement of the two parts with respect to each other is possible without the introduction of restoring forces into the glass plate. This capability also guarantees the adjustable bias between the clamping element and the clamping bell.

As a result of the multiple partitioning of the clamp fitting by at least one additional three-dimensionally articulated hinge, not only does it have a good ability to adapt to large manufacturing and construction tolerances, but to a certain extent, the individual articulation points of the three-dimensionally articulated hinges, with a fixed bracing after installation, also form nodes with a certain inherent elasticity which also contributes to the stress-free mounting of the glass plate.

As a result of the characterizing feature, i.e. as a result of the arrangement of the spherical surfaces that are mounted with lateral clearance and the corresponding support of the bolt head on the above mentioned spherical surfaces, a rather large angular deviation between the components to be connected with each other is possible, which is advantageous in particular for a corner connection of a plurality of glass wall segments that are adjacent to one another by means of connecting bridges.

Additional advantages and aspects of the invention are disclosed herein below.

In one advantageous development of the invention, the bolt head of the pendulum bolt is split or divided orthogonally with respect to the longitudinal axis of the shank of the bolt so that the plane surface of a plano-convex lens is in contact against a plane surface of the bolt head, and the plano-concave lenses that have the spherical surfaces are guided with lateral play in the union nut. This arrangement, depending on the angular deviation of the shank of the pendulum bolt with respect to the union nut, makes possible a sufficient relative displacement of the lenses that have the spherical surfaces with respect to the head of the pendulum bolt, so that even rather large tolerances can be equalized.

In a further development of the invention, the bolt head of the pendulum bolt has a male thread for connection to an articulated connection for connecting pieces between the glass segments, whereby this articulated connection can be realized, for example, in the form of a hinge fork in which an articulated bracket of a connecting bridge is engaged.

The result is that the invention in one aspect teaches a clamp fitting with two three-dimensionally articulated hinges, one three-dimensionally articulated hinge of which is formed essentially by a substantially permanently elastic spring element, while the second three-dimensionally articulated hinge makes it possible, using simple construction means, to compensate for large tolerances with respect to any desired connecting elements.

The above-discussed embodiments of the present invention will be described further hereinbelow. When the word "invention" is used in this specification, the word "invention" includes "inventions", that is the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to one exemplary embodiment illustrated in the accompanying drawings, in which.

DESCRIPTION OF THE PREFERRED EMBODIMENT

Figure 1:
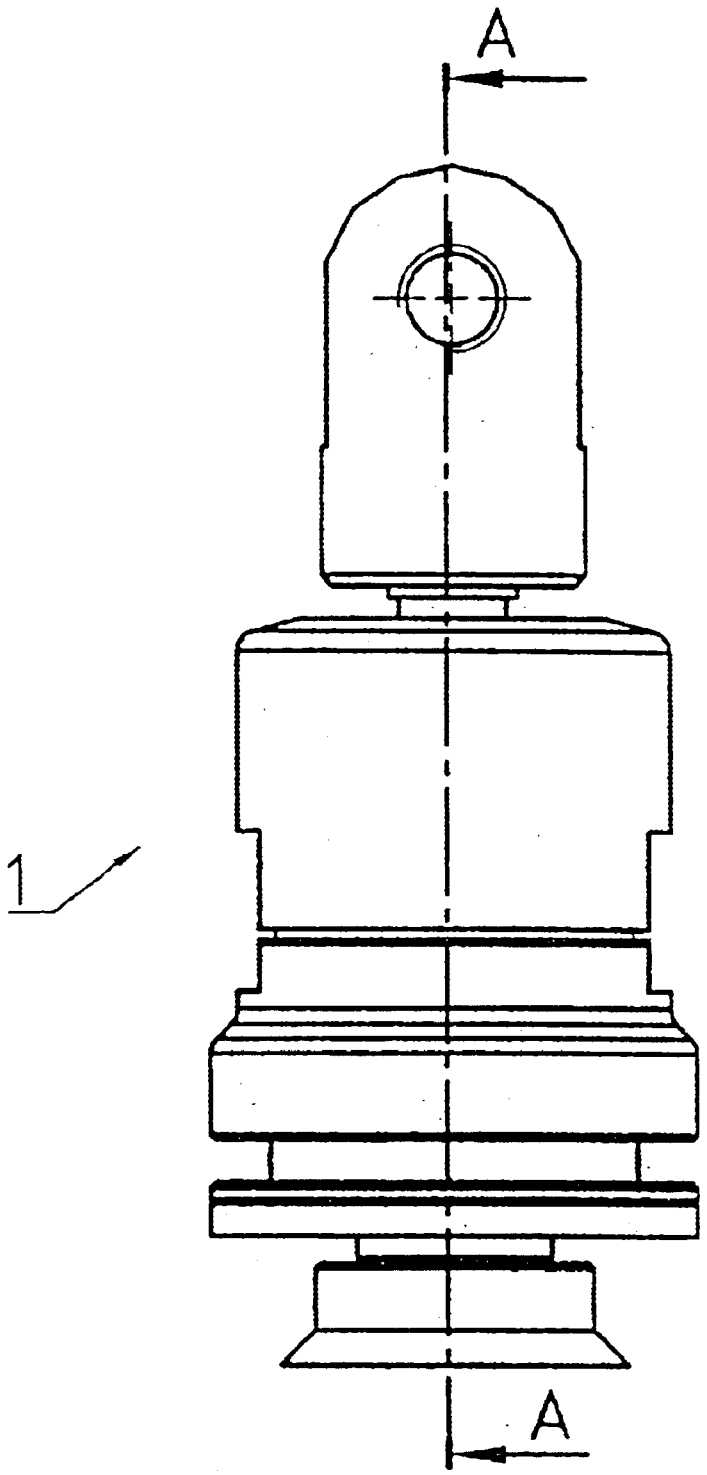
FIG. 1 is a side view of a clamp fitting in accordance with one aspect of the invention.
Figure 1A:
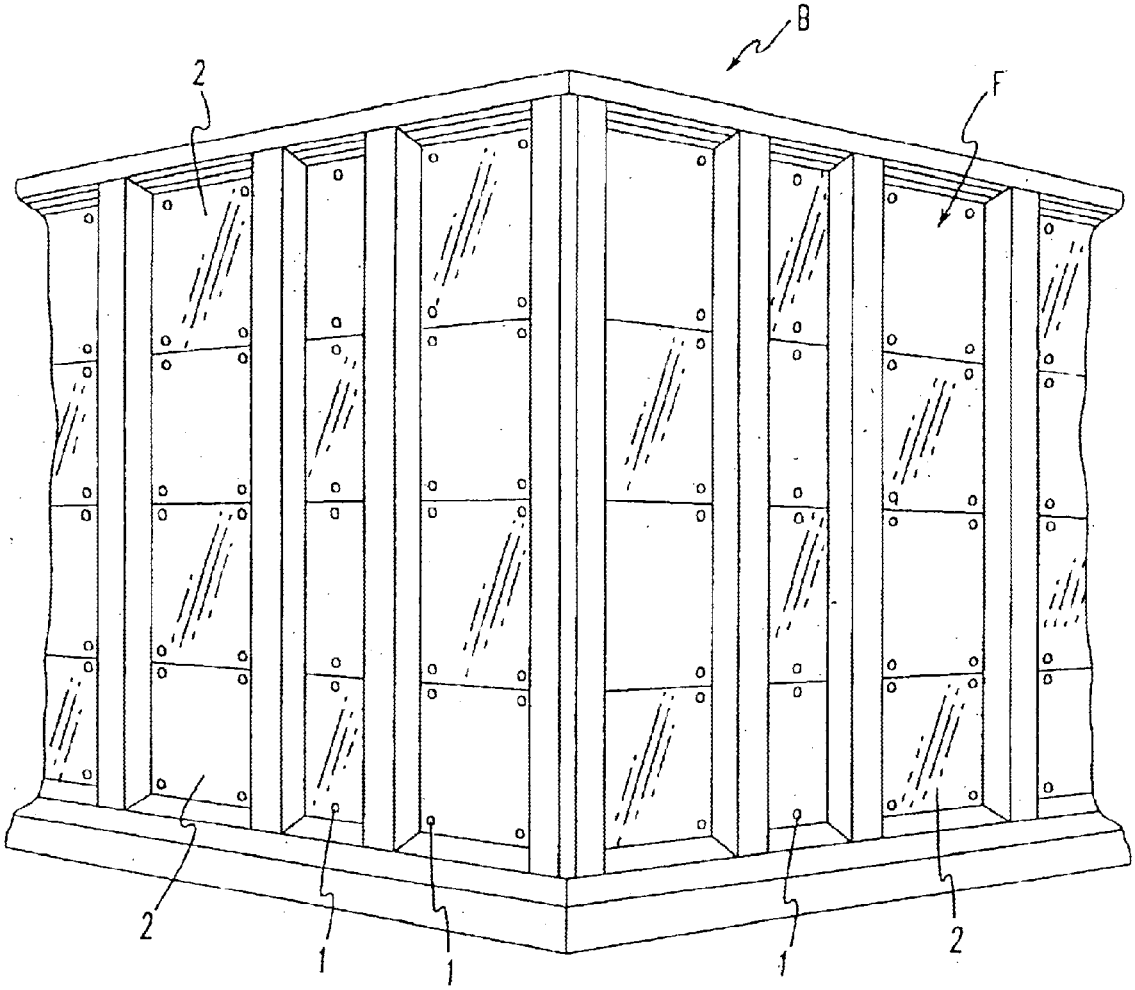
FIG. 1A is a perspective view of a building with facades with clamp fittings in accordance with one aspect of the invention.

FIG. 1A illustrates a building B with a facade F. The facade F is comprised of a plurality of glass panes, plates or panels 2 which are secured to the building by clamp fittings 1 as will be described in greater detail below.

Figure 1B:
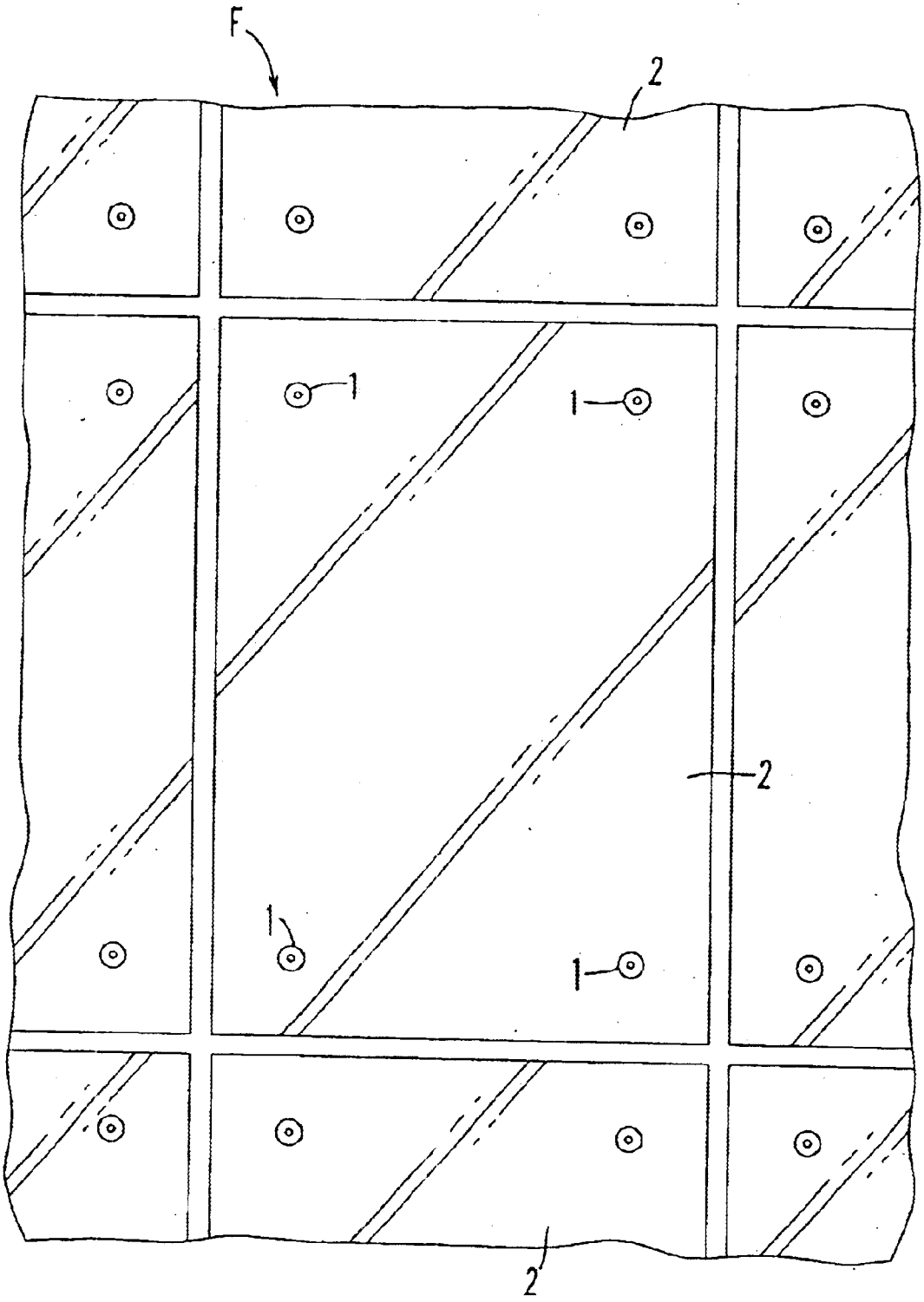
FIG. 1B is an elevational view of a portion of a facade of glass panels with clamp fittings.

FIG. 1B illustrates a portion of the facade F with glass panels or panes 2 and four clamp fittings 1 for each glass pane 2.

Figure 2:
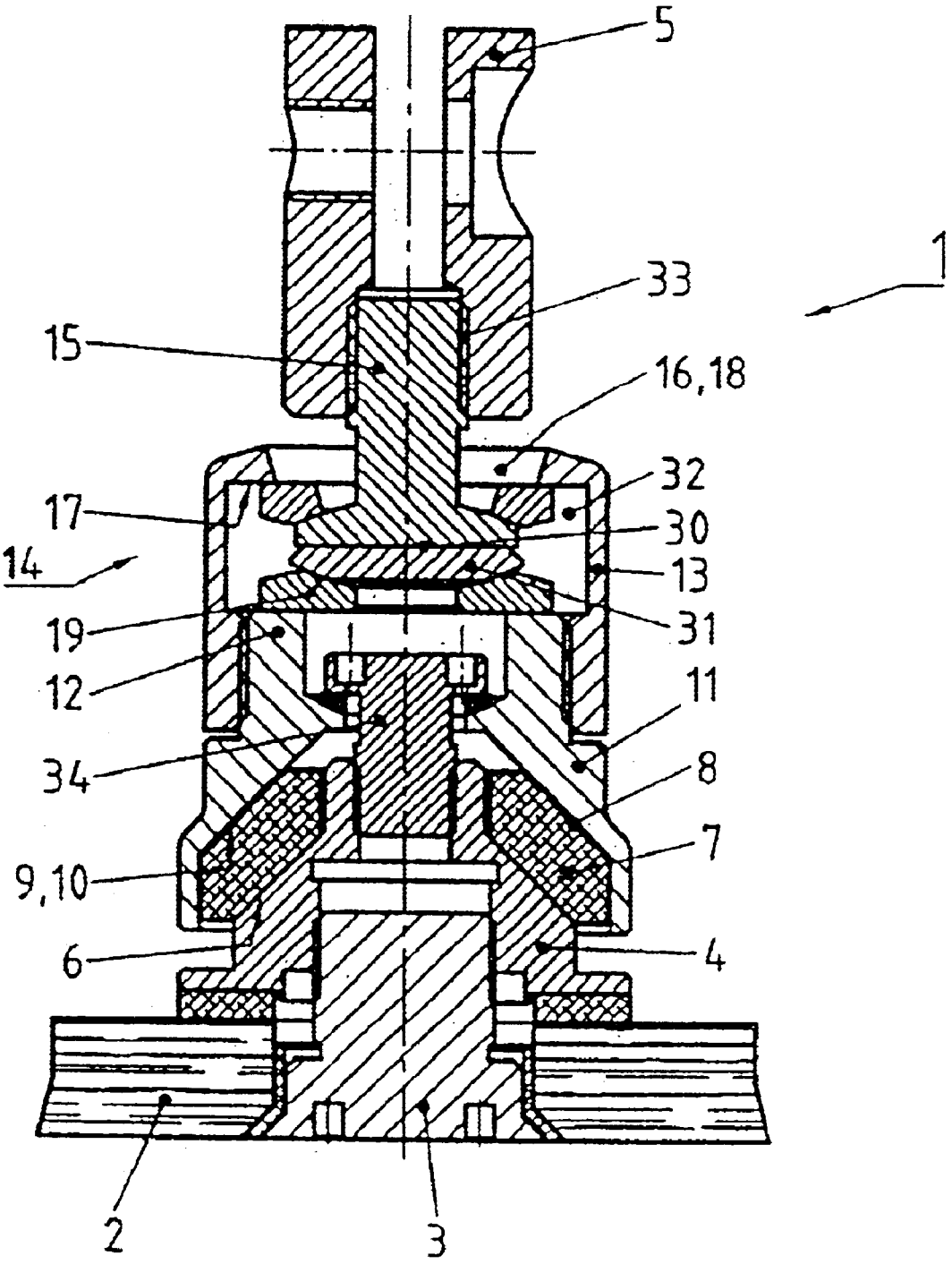
FIG. 2 is a section along line A—A shown in FIG. 1.
Figure 3:
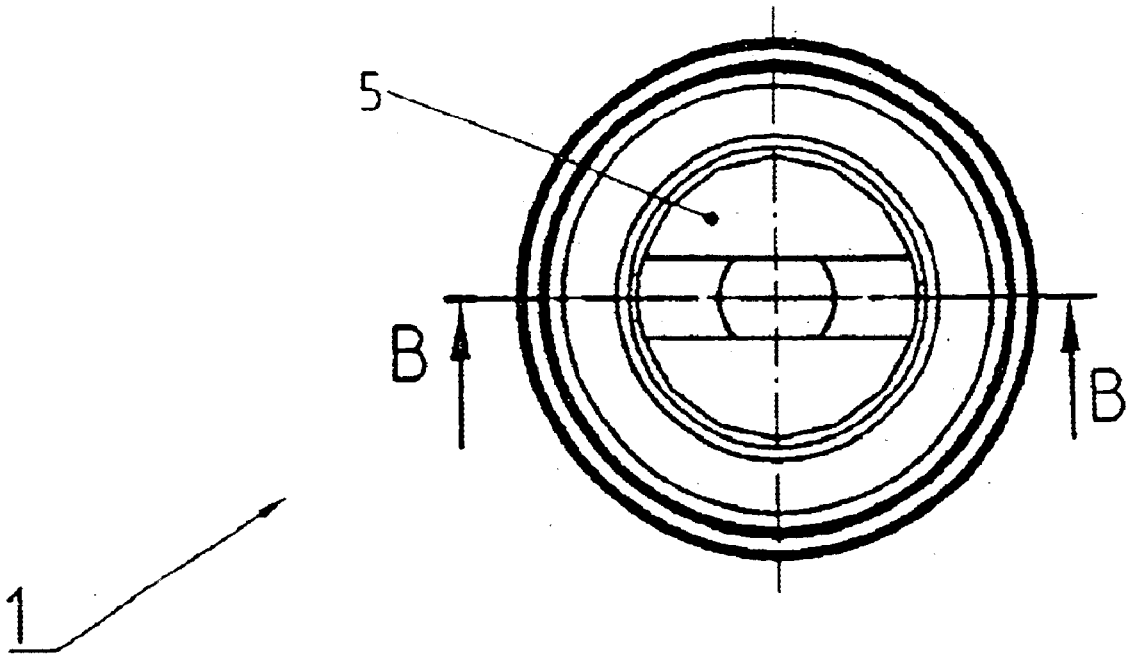
FIG. 3 is a plan view of the clamp fitting illustrated in FIG. 1, and it also defines section B—B.

A clamp fitting 1, as illustrated in FIGS. 1, 2 and 3, has two clamp elements 3 and 4, which enclose between them a glass plate or pane 2 with the interposition of a glass protector not illustrated in any further detail. As shown, the clamp element 3 is bolted into the clamp element 4. The clamp element 4 is in contact with its lateral surface designated 6 against a substantially permanently elastic spring element 7, which for its part has a conical lateral surface 8, with which a complementary surface 9 of an inner lateral surface 10 of a clamping bell 11 is in contact. The bias of the substantially permanently elastic spring element 7 can be determined by a clamping bell set screw 34 which is screwed into the clamp element 4. A bolt head 36 (See FIG. 4) of the clamping bell set screw 34 is thereby supported by means of a plane-convex lens 37 on the clamping bell 11.

Figure 6:
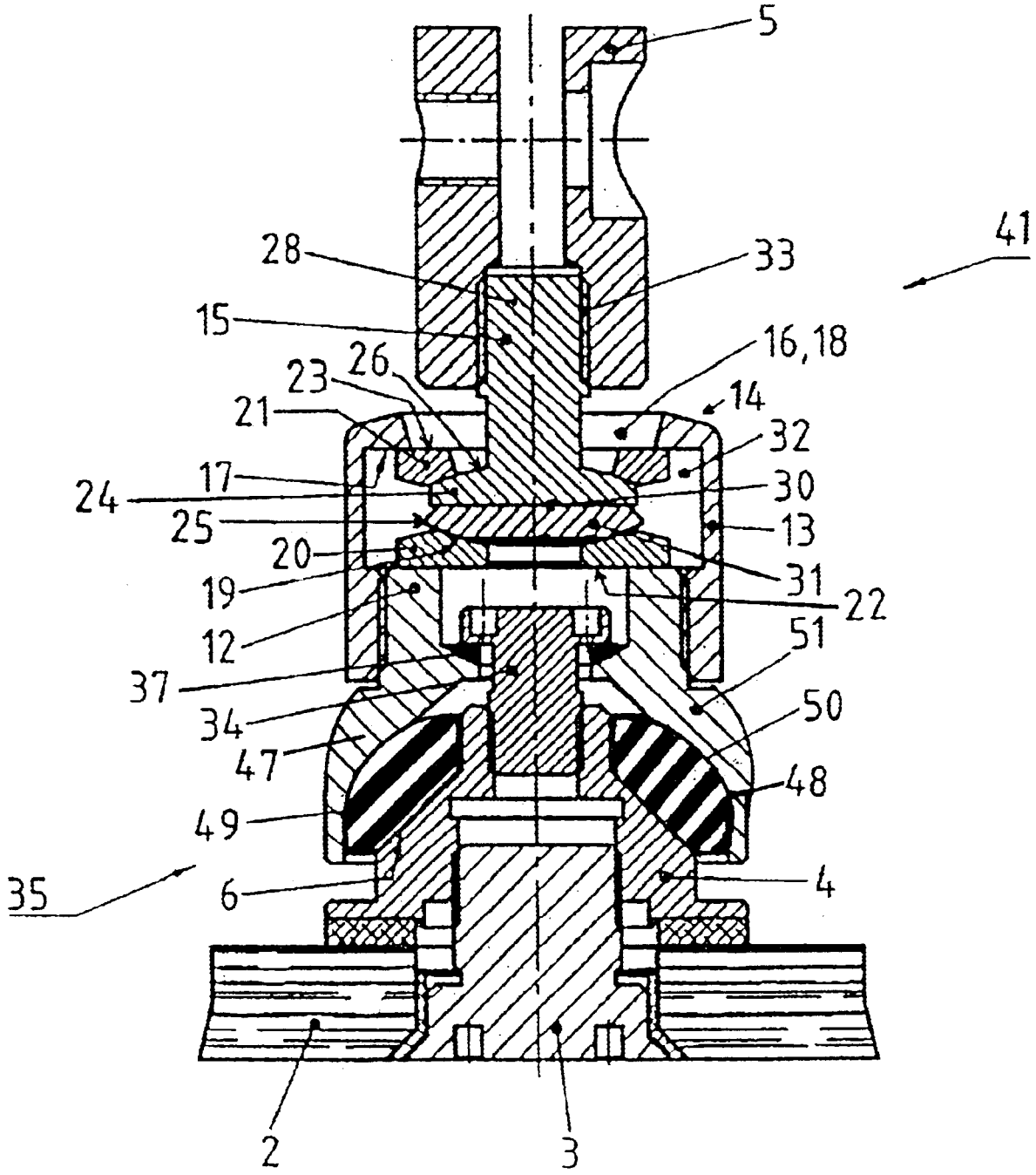
FIG. 6 is a view similar to FIG. 2 of an embodiment wherein the clamping bell and the substantially permanently elastic spring member have rounded surfaces, and identifying additional details.

An alternative form for the clamping bell is illustrated in FIG. 6. Clamp fitting 41 has a clamping bell 51 having a spherical inner surface 49 that is clamped against spherical lateral surface 48 of substantially permanently elastic spring element 47. The clamping bell 11 or 51 has a cylindrical extension 12 with a male thread which is not described in any further detail, onto which a union nut 13 is screwed. Between the base 17 of the cup portion of the union nut 13 and the clamping bell 11 or 51 a second three-dimensionally articulated hinge designated 14 is formed. For this purpose there are two plano-concave lenses 20 and 21, whereby the lens 20 is in contact with its plane surface 22 (see FIG. 4) with the cylindrical extension 12, while the lens 21 is in contact with its plane surface 23 against the base 17 of the cup portion of the union nut 13. A bolt head 24 is in contact with its complementary surfaces 25 and 26 against the spherical surfaces 19 formed by the lenses 20 and 21. A bolt shank 28 of a pendulum bolt 15 runs with some clearance or play 18 through an opening 16 in the base 17 of the cup portion of the union nut 13.

Figure 4:
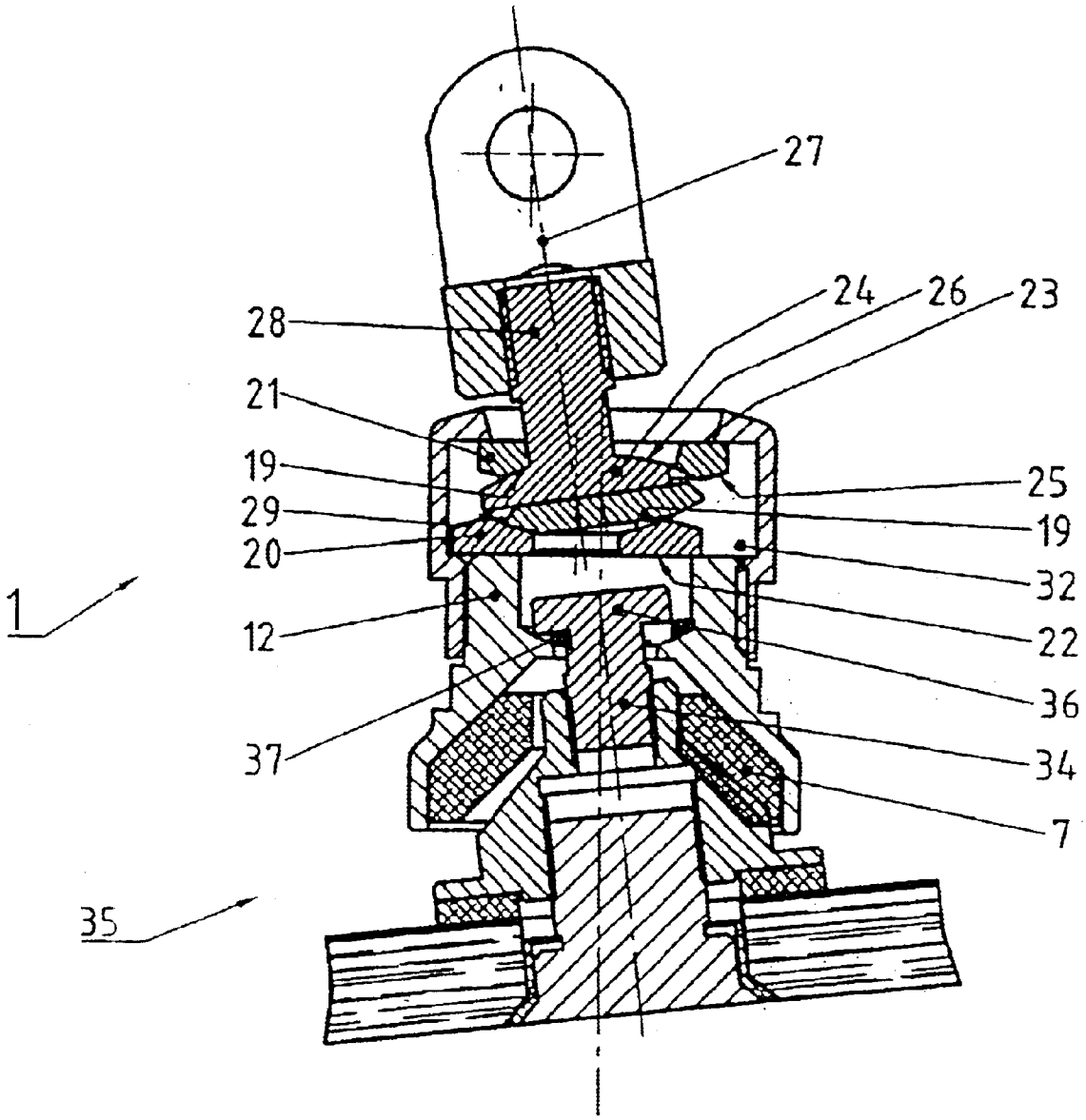
FIG. 4 is an illustration, in a section corresponding to FIG. 2, of the capability of maximum displacement of the two three-dimensionally articulated pivot arrangements.

FIG. 4 shows that both the bolt head 24 of the pendulum bolt 15 and the plano-concave lenses 20 and 21 are guided with lateral clearance 32 in the union nut 13.

Figure 5:
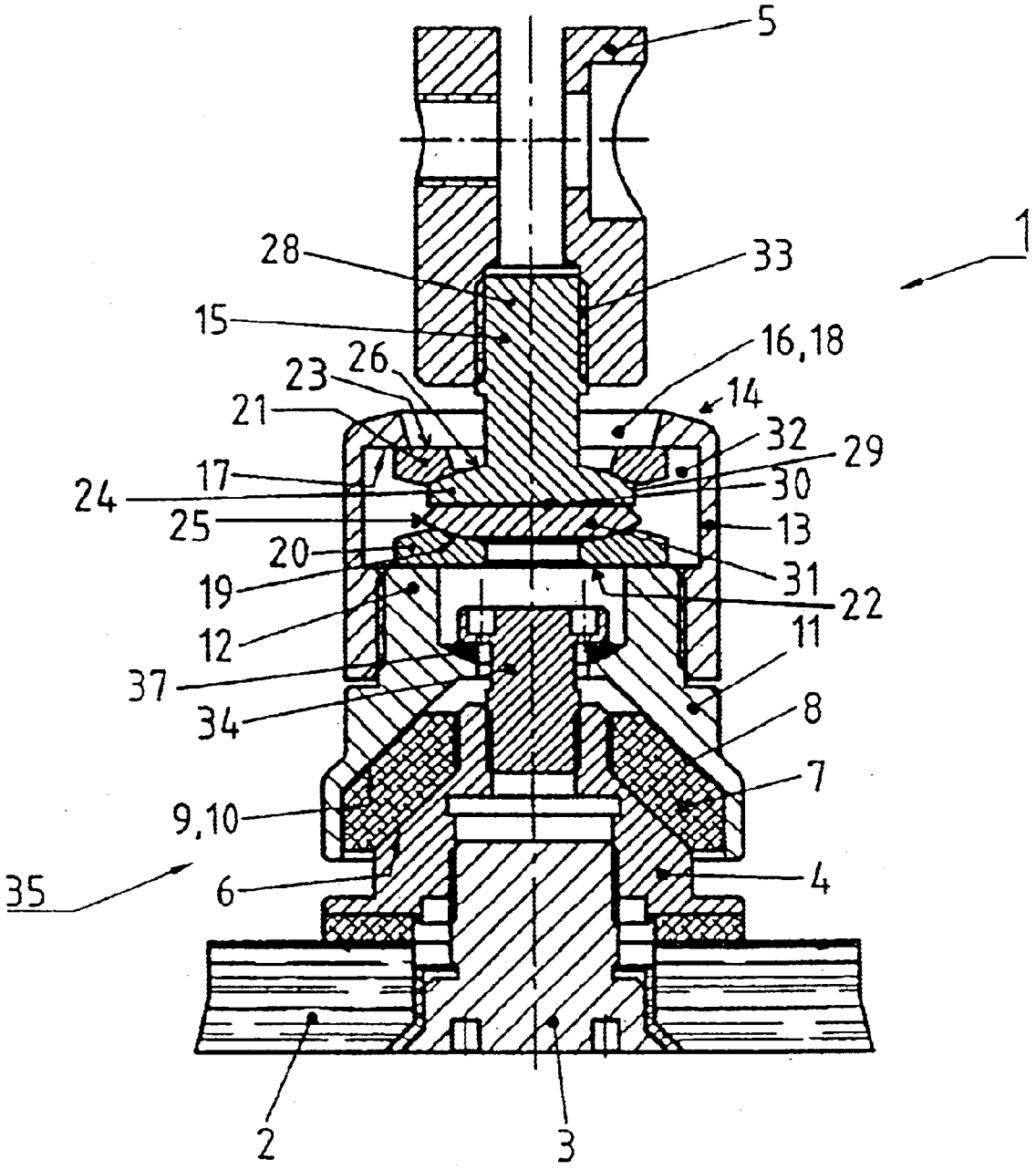
FIG. 5 is an illustration in a section corresponding to FIG. 2 and identifying additional details.

FIG. 5 is a view similar to FIG. 2, but identifying additional components.

As shown in FIGS. 2, 4, and 6, the bolt head 24 of the pendulum bolt 15 is divided or split orthogonally with respect to a longitudinal axis 27, so that adjacent to the bolt shank 28 there is a plane surface 29, against which a plane surface 30 of a plano-convex lens 31 is in contact. The plano-convex lens 31 is guided with its complementary surface 25 on the spherical surface 19, while the other part of the bolt head 24 is guided with its complementary surface 26 on the spherical surface 19 of the plano-concave lens 21.

The figures show that essentially on account of the three-dimensionally articulated hinge or articulated arrangement 35 formed by the substantially permanently elastic spring element 7 on the one hand and the additional three-dimensionally articulated hinge or articulated arrangement 14 that can be fixed in position by means of the union nut 13, with elastic clamping of the glass plate 2, a large range of tolerance is guaranteed, which is advantageous in particular with the use of an articulated connection 5 for the connection with connecting bridges. The articulated connection or device 5 thereby has a female thread, into which the bolt shank 28 of the pendulum bolt 15, which has a male thread 33, is screwed and is thus connected.

Figure 7:
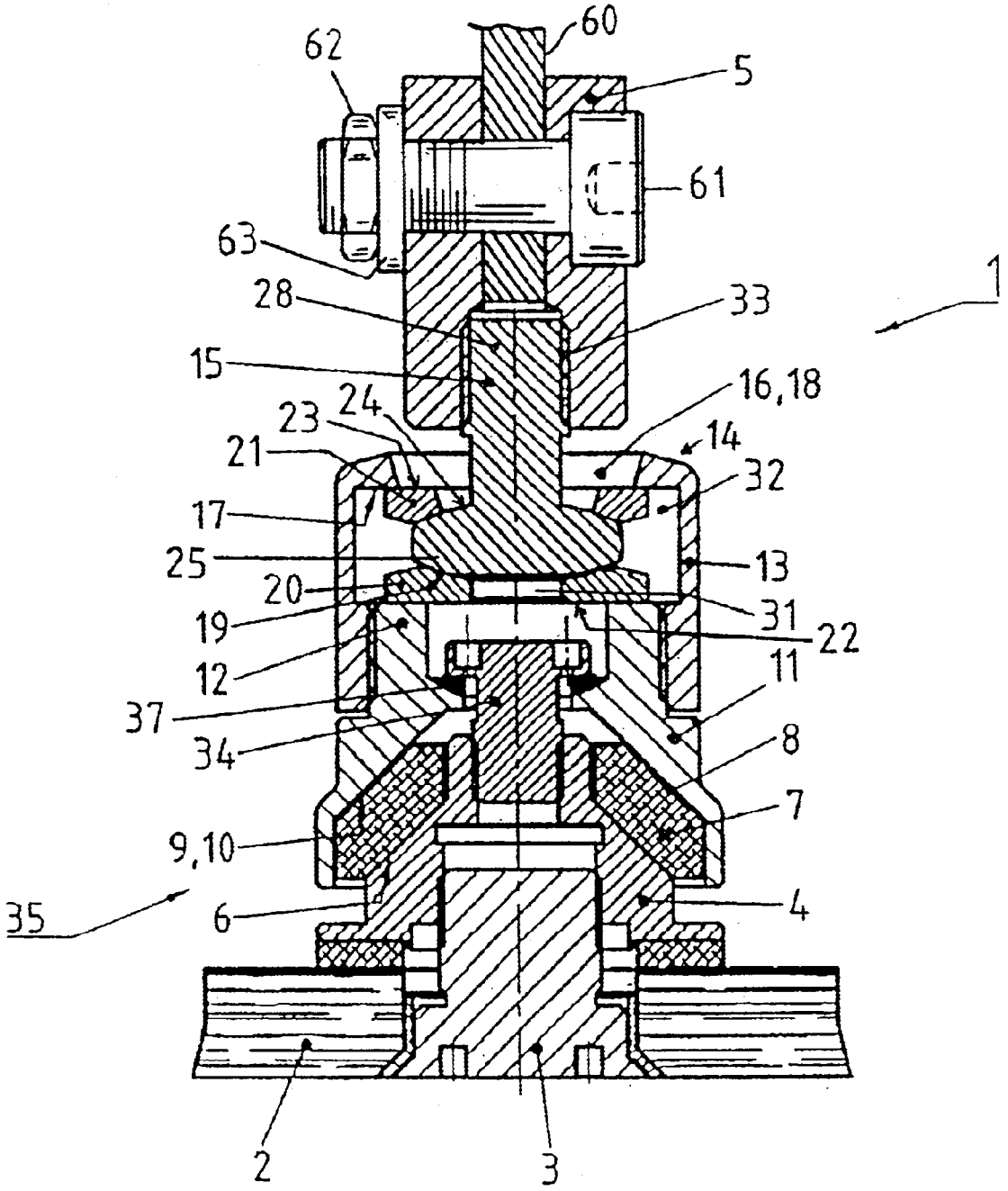
FIG. 7 is a view similar to FIG. 2 and particularly showing details of attaching a clamp fitting to a member of a building structure.

FIG. 7 is a view similar to FIG. 2 and illustrates a member 60 which is secured to a building structure, such as building B. The member 60 is secured to the clevis element or device 5 by means of a threaded fastener connection comprising, for example, an assembly comprising a bolt 61, a nut 62, and a washer 63. It will be appreciated that other means of fastening the clevis member or device 5 to the bolt member 15 may be utilized. It is also within the scope of the present invention to provide a fastener through the shank 28 and the end of clevis member 5 that is threadingly connected to the shank 28.

One feature of the invention resides broadly in a clamp fitting 1 or 41 for a glass plate 2 with two clamp elements 3, 4 that clamp the glass plate 2 between them and a three-dimensionally articulated support of the clamp fitting 1 or 41 on a fastening device, whereby a clamp element 4, on its lateral surface 6 facing away from the glass plate 2 has a conical lateral surface 8 or spherical lateral surface 48 formed by a substantially permanently elastic spring element 7 or 47, against which lateral surface 8 or 48 a complementary surface 9 or 49 of an interior lateral surface 10 or 50 of a clamping bell 11 or 51 can be placed in contact with adjustable bias. Located between the clamping bell 11 or 51 and a union nut that covers a cylindrical extension 12 of the clamping bell 11 or 51 there is a three-dimensionally articulated hinge 14 that can be fixed in position, whereby a pendulum bolt 15 runs though an opening 16 in the cup base 17 of the union nut 13 with clearance 18, characterized by the fact that the three-dimensionally articulated hinge 14 has two plano-concave lenses 20, 21 with their spherical surfaces 19 facing each other, the first lens 20 is in contact with its plane surface 22 against the cylindrical extension 12 of the clamping bell 11 or 51 and the second lens 21 is in contact with its plane surface 23 on the cup base 17 of the union nut 13, and that a bolt head 24 of the pendulum bolt 15 is guided with correspondingly convex complementary surfaces 25, 26 on spherical surfaces 19 of the lenses 20, 21.

Another feature of the invention resides broadly in a clamp fitting 1 or 41, characterized by the fact that the bolt head 24 of the pendulum bolt 15 is divided orthogonally to the longitudinal axis 27 of the bolt shank 28 so that a plano-convex lens 31 is in contact with a plane surface 29 of the bolt head 24, and the plano-concave lenses 20, 21 having the spherical surface 19 are guided with lateral clearance in the union nut.

Yet another feature of the invention resides broadly in a clamp fitting, characterized by the fact that the bolt shank 28 of the pendulum bolt 15 has a male thread 33 for the connection with an articulated connection 5 for connecting bridges for glass wall segments.

In an additional aspect, the present invention is a clamp fitting 1 or 41 for a glass plate 2 with two clamp elements 3 and 4 that clamp the glass plate 2 between them and a three-dimensionally articulated support of the clamp fitting 1 or 41 on a fastening device. The clamp element 4, on its lateral surface 6, facing away from the glass plate 2, engages a substantially permanently elastic spring element 7 or 47 having a conical lateral 8 or a spherical lateral surface 48.

A complementary surface 9 or 49 of an interior lateral surface 10 or 50 of clamping bell 11 or 51 engages spherical lateral surface 8 or 48 of substantially permanently elastic spring element 7 or 47 with adjustable bias. Located between the clamping bell 11 or 51 and a union nut that covers a cylindrical extension 12 of the clamping bell 11 or 51 there is a three-dimensionally articulated hinge 14 that can be fixed in position, whereby a pendulum bolt 15 runs though an opening 16 in the cup base 17 of the union nut 13 with clearance, characterized by the fact that the three-dimensionally articulated hinge 14 has two plano-concave lenses 20, 21 facing each other with their spherical surfaces 1, the first lens 20 is in contact with its plane surface 22 against the cylindrical extension 12 of the clamping bell 11 and the second lens 21 is in contact with its plane surface 23 on the cup base 17 of the union nut 13, and that a bolt head 24 of the pendulum bolt 15 is guided with correspondingly convex complementary surfaces 25, 26 on spherical surfaces 19 of the lenses 20, 21.

In an optional variation, the clamp fitting, 1 or 41, may be further characterized by having the bolt head 24 of the pendulum bolt 15 divided orthogonally to the longitudinal axis 27 of the bolt shank 28 so that a plano-convex lens 31 is in contact with a plane surface 29 of the bolt head 24, and the plano-concave lenses 20, 21 having the spherical surface 19 are guided with lateral clearance in the union nut.

In another variation, the clamp fitting 1 or 41 is characterized by the bolt shank 28 of the pendulum bolt 15 having a male thread 33 for the connection with an articulated connection 5 for connecting bridges for glass wall segments.

The invention further teaches that the three-dimensionally articulated hinge or articulated arrangement 14 has two plano-concave lenses 20, 21 with their spherical surfaces 19 facing each other, the first lens 20 is in contact with its plane surface 22 against the cylindrical extension 12 of the clamping bell 11 or 51 and the second lens 21 is in contact with its plane surface 23 on the cup base 17 of the union nut 13, and that a bolt head 24 of the pendulum bolt 15 is guided with correspondingly convex complementary surfaces 25, 26 on spherical surfaces 19 of the lenses 20, 21.

Thus, in one aspect the invention relates to fastening devices for glass plates and, more particularly, the present invention relates in one aspect to fastening devices for glass plates that permit stress free adjustment and which have flexibility whereby thermal and mechanical stresses on the glass plates are reduced.

The components disclosed in the various publications, disclosed or incorporated by reference herein, may be used in the embodiments of the present invention, as well as equivalents thereof.

The appended drawings in their entirety, including all dimensions, proportions and/or shapes in at least one embodiment of the invention, are accurate and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The following patents, patent applications, or patent publications and other publications, which were cited in the International Search Report in International Patent Application No. PCT/EP00/12151, dated Mar. 5, 2001 are hereby incorporated by reference as if set forth in their entirety herein as follows: DE 195 36 331 of Apr. 3, 1997 to SEELE GMBH; DE 19 31 089 of Feb. 19, 1970 to BETEILIGUNGS-AG FÜR HAUSTECHNIK; and WO 99 63193 of Dec. 9, 1999 to DORMA GMBH & CO KG, corresponding to U.S. Pat. No. 6,254,397 issued to inventor Elmer on Jul. 3, 2001 and entitled "Attachment device for a glass pane at a mounting fixed to a structure."

The corresponding foreign and international published patent applications, namely Application No. WO 0142610, published on Jun. 14, 2001, having inventor Hubert ELMER, as well as its equivalents, including Austrian Application No. AU 1707001 and Federal Republic of Germany Application No. DE 199 56 622 as well as their published equivalents, and other equivalents or corresponding applications, if any, in corresponding cases in the European Community and elsewhere, and the references and documents cited in any of the documents cited herein, such as the patents, patent applications and publications, are hereby incorporated by reference as if set forth in their entirety herein. Likewise the references and documents cited in any of the documents cited herein, such as the patents, patent applications and publications, are hereby incorporated by reference as if set forth in their entirety herein. All of the documents cited herein, referred to in the immediately preceding sentence, include all of the patents, patent applications and publications cited anywhere in the present application.

All of the references and documents, cited in any of the documents cited herein, and the references they are in turn cited in are hereby incorporated by reference as if set forth in their entirety herein. All of the documents cited herein, referred to in the immediately preceding sentence, include all of the patents, patent applications and publications cited anywhere in the present application. All of the references included herein as aforesaid include the corresponding equivalents published by the United States Patent and Trademark Office and elsewhere.

The details in the patents, patent applications and publications may be considered to be incorporable, at Applicant's option, into the claims during prosecution as further limitations in the claims to patentably distinguish any amended claims from any applied prior art.

The following U.S. patents and patent applications, relating to glass pane mountings, are hereby incorporated by reference as if set forth in their entirety herein: U.S. Pat. No. 6,131,346, having attorney docket No. NHL-DOR-54 US, having inventor Herbert KORDES, issued on Oct. 17, 2000 and entitled, "Clamping fitting to attach glass panes"; U.S. Pat. No. 6,158,177, having attorney docket No. NHL-DOR-48 US, having inventor Ernst Udo BLÖBAUM, issued on Dec. 12, 2000 and entitled, "Clamping mounting for glass plates, and a kit to construct a clamping mounting to mount glass plates, and a method to utilize a kit to construct a clamping mounting to mount glass plates"; U.S. Pat. No. 6,254,397, having attorney docket No. NHL-DOR-68 US, having inventor Hubert ELMER, issued on Jul. 3, 2001 and entitled, "Attachment device for a glass pane at a mounting fixed to a structure"; U.S. Pat. No. 6,182,404, issued on Feb. 6, 2001, having attorney docket no. NHL-RBB-05 and having inventors Manfred Rinklake and Norbert Rosler; and U.S. Pat. No. 6,105,331, issued on Aug. 22, 2000, having attorney docket no. NHL-RBB-06 and having inventors Manfred Rinklake and Norbert Rosler; U.S. patent application Ser. No. 09/731,265, having attorney docket No. NHL-DOR-83 US, having inventors Ernst Udo BLÖBAUM and Reinhard JANUTTA, filed on Dec. 6, 2000 and entitled, "Building glass facade of a building, a clamping arrangement for holding glass panels in a glass facade of a building, a brace to hold safety glass panels in a glass facade of a building, and a brace to hold safety glass panels"; U.S. patent application Ser. No. 09/854,411, having attorney docket No. NHL-DOR-91 US, filed on May 11, 2001 and entitled "A glass display case being held together by clamping fittings and a clamping fitting for the corner connection of three adjoining walls, especially glass panes in glass display cases", having inventor Hubert ELMER, claiming priority from Federal Republic of Germany Patent Application NO. 199 43 565.0, having inventor Hubert ELMER, filed on Sep. 13, 1999 and entitled, "Klemmbeschlag für die Eckverbindung von drei aneinander grenzenden Wänden"; U.S. patent application Ser. No. 09/835,865, filed on Apr. 16, 2001, and entitled "Clamp fitting for fastening glass plates", having attorney docket No. NHL-DOR-92 US, having inventors Ralf KREYENBORG, Dirk SCHULTE, and Ernst Udo BLÖBAUM, claiming priority from Federal Republic of Germany Patent Application No. 199 38 571,8, having inventors Ralf KREYENBORG, Dirk SCHULTE, and Ernst Udo BLÖBAUM, filed on Aug. 17, 1999 and entitled, "Klemmbeschlag für die Befestigung von Glasscheiben"; U.S. patent application Ser. No. 09/838,349, filed on Apr. 19, 2001, and entitled "An attachment device for mounting a glass pane fixedly to a structure, such as a building and a facade having attachment devices for mounting glass panes fixedly to a structure, such as a building", having attorney docket No. NHL-DOR-93 US, having inventor Lothar GINZEL, claiming priority from Federal Republic of Germany Patent Application No. 199 39 172.6, having inventor Lothar GINZEL, filed on Aug. 20, 1999 and entitled, "Punktförmige Halterung für Isolierglasscheiben"; U.S. patent application Ser. No. 09/861,458, filed on May 18, 2001, and entitled "Fastening device with multiple holders for holding a glass panel, a plurality of glass panels, such as a building facade, held together by fastening devices with multiple holders, and a method of fastening a facade on a structure, such as a building, with a fastening device with multiple holders", having attorney docket No. NHL-DOR-94 US, having inventor Hubert ELMER, claiming priority from Federal Republic of Germany Patent Application No. 199 45 197.4, having inventor Hubert ELMER, filed on Aug. 20, 1999 and entitled "Befestigungsvorrichtung für eine Glasscheibe"; U.S. patent application Ser. No. 09/862,031, filed on May 18, 2001, and entitled "Fastening device with a single holder for fastening a glass panel to a building or the like and a plurality of glass panels, such as a building facade, held together by a fastening device with a single holder and a method of fastening a facade on a structure, such as a building with a fastening device with a single holder", having attorney docket No. NHL-DOR-96 US, having inventor Hubert ELMER, claiming priority from Federal Republic of Germany Patent Application No. 199 45 196.6, having inventor Hubert ELMER, filed on Sep. 21, 1999 and entitled, "Befestigungsvorrichtung für eine Glasscheibe"; and U.S. patent application Ser. No. 10/036,847, filed on Dec. 21, 2001, and entitled "A building glass facade, a method for mounting glass panes in a building glass facade, and a clamping arrangement for mounting glass panes in a building glass facade", having attorney docket No. NHL-DOR-105, having inventor Hubert ELMER, claiming priority from Federal Republic of Germany Patent Application No. 101 01 517.8, having inventor Hubert ELMER, filed on Jan. 12, 2001, and entitled "Klemmbeschlag für die Befestigung von Glasscheiben".

The U.S. patent application Ser. No. 09/730,083 filed on Dec. 5, 2000 having attorney docket No. NHL-DOR-79, inventors Hubert ELMER et al. and entitled "Building Glass Façade of a Building, Clamping Arrangement in a Façade, and a Clamping Arrangement for Clamping a Building Glass Pane in a Façade" describes a clamping arrangement having both a first and a second angle adjustment mechanism.

The façade described in that application includes a plurality of glass elements covering at least a portion of the building, at least one of the glass elements including a glass pane. The glass pane has a first side, a second side, and a hole connecting the first and second sides. The façade includes a clamping arrangement having a portion disposed through the hole in the glass pane. The clamping arrangement includes a first clamp device on the first side of the glass pane and a second clamp device on the second side of the glass pane. The clamping arrangement is configured and disposed to secure the glass pane in a clamped attitude.

The clamping arrangement includes a first angle adjustment arrangement that is configured and disposed to adjust an angle of the clamping arrangement. The first angle adjustment arrangement comprises a pivot joint arrangement configured to permit substantially multi-directional pivotal movement of the second clamp device to adjust and hold the position of the glass pane securely relative to the building. The clamping arrangement is supported on the second side of the glass pane by the first pivot joint arrangement.

The clamping arrangement also includes a second angle adjustment arrangement that is configured and disposed to adjust another angle of the clamping arrangement. The second angle adjustment arrangement is connected in tandem with the first angle adjustment arrangement to adjust for irregularities in the glass pane and for irregularities in the building to thus hold the glass pane firmly in the façade. The second angle adjustment arrangement includes a pivot joint arrangement configured to permit substantially multi-directional movement of at least a portion of the first angle adjustment arrangement relative to the building to thus adjust for irregularities of the glass pane and for irregularities in the building and to thus firmly hold the position of the glass pane relative to the building.

The first angle adjustment arrangement has a conical or spherical surface that is provided by a substantially permanently elastic spring member disposed on that glass side which is facing away from the glass pane. Against this conical or spherical surface a complementing or mating surface of the interior or mantle of a bell-shaped housing can be set with pre-stressing. Between the bell-shaped housing and a securement screw on one hand and a securement screw and the holding device on the other hand, pivot joints are provided that include rigidity control, in other words, that can be locked in place or position.

That application further teaches that wind pressure and thermal stresses are absorbed by the elastic support of the bell-shaped housing at the first clamp element, because after the assembly is secured, a relative movement of the two components with respect to one another can occur without the introduction of restoring forces into the glass pane. This is assured by the adjustable pre-stressing effected between the clamp element and the bell-shaped housing.

A well-matched adaptation to large tolerances of construction is provided by the multi-segmented, partitioned structure of the fastening assembly that has least two pivot joints. Also, the individual hinge points of the pivot joints form, upon being assembled, framework points that have a certain inherent elasticity. These additionally contribute to the stress-free mounting or fastening of the glass pane.

In accordance with one embodiment taught in that application, the first clamp element or device itself can have, at its mantle surface area that is facing away from the glass pane, a conical or spherical surface. As a matter of principle, the conical or spherical surface can be provided by the aforementioned substantially permanently elastic spring member, even when the clamp element has planar surfaces.

Furthermore, in one embodiment taught in that application, the first or interior clamp element has a central through bore having internal screw threading for receiving therein a locking screw which connects the clamp elements to one another. There is also an adjustment screw for connecting the bell-shaped housing with the interior clamp element, whereby in accordance with the teaching of that application, the substantially permanently elastic spring member is configured as a substantially permanently elastic pillow which is disposed between the conical or spherical surface of the interior clamp element that is facing the glass pane and the complementing surface of the bell-shaped housing. By means of the mentioned adjustment screw for the bell-shaped housing, the substantially permanently elastic pillow can be clamped to such an extent that not only does the pillow as such absorb stresses directed into the glass pane, but there is also provision for a relative shifting of the bell-shaped housing with respect to the substantially permanently elastic pillow, for supporting the glass pane in substantially stress-free manner.

In accordance with a special feature cited in that application, the bell-shaped housing has, on its side facing the holding device, a cylindrical extension comprising external screw threading and between this cylindrical extension and the bell-shaped housing, in the region of the bottom wall of the bell-shaped housing, there is disposed an inwardly directed flange which serves as support for the screw head of the adjustment screw of the bell-shaped housing. Free play provided between the flange and a shaft of the adjustment screw for the bell-shaped housing allows the arrangement of a disc in the form of a lens-shaped spacer between the flange and the screw head of the adjustment screw for the bell-shaped housing, in such a way that the shaft of the adjustment screw for the bell-shaped housing can carry out a pendulum motion relative to the bell-shaped housing. This pendulum motion is facilitated when the support surface of the flange and the complementing surface of the lens-shaped spacer extend in conical or spherical manner.

It is advantageous that use is made of a non-metallic lens-shaped spacer comprised, for example, of a hard rubber with gliding properties. In this manner, there is provided in a practical way an additional pivot joint between the bell-shaped housing and the interior clamp element and, accordingly, the glass pane.

A further pivot joint is provided by having the face of the extension directed towards the holding device curved in concave or lens-shaped manner. Also, a cup-like swivel nut or encasing nut, or bell-shaped nut, which extends over the outer screw threading of the cylindrical extension of the bell-shaped housing, has an inner bottom wall which is curved in the direction opposite to the forward face of the extension of the bell-shaped housing. Hence, between the forward face of the extension of the bell-shaped housing and the bottom wall of the swivel, or bell-shaped nut, there can be accommodated two lens-shaped spacers which are in contact with one another with their respective planar surfaces. By means of the above-described swivel nut, the described pivot joint can be rigidly disposed when the final assembly has been established.

In an advantageous embodiment taught in that application, the plano-convex, lens-shaped spacer that contacts the bottom wall of the swivel, or bell-shaped nut, is a component of a nut which receives the securement screw, whereby the securement screw can be screwed more or less deeply into the nut, for the purpose of a desired shortening or extending of the longitudinal extent of the entire fastening assembly. In order to achieve the mentioned pivot joint, the shaft of the nut is dimensioned such that it passes with clearance through a bore in the bottom wall of the bell-shaped nut.

A further pivot joint can, in known manner, be realized in the region of the direct connection of the securement screw with the holding device, in that the securement screw passes with clearance through a bore in the holding device and the holding device is secured between a nut and a locknut.

A plano-convex, lens-shaped spacer is provided between the nut and the locknut on one hand and the holding device on the other hand. The plano-convex, lens-shaped spacer is in contact with its planar surface with the holding device, and the nut and locknut have support surfaces that are complementing the surface of the lens-shaped spacer. Again, during final assembly of the respective components an adjustable and adaptable pivot joint is achieved which, upon completion of the assembly phase, can be controlled as to rigidity, or in other words, can be locked in place and position. Hence, between the last-mentioned pivot joint, which provides the connection to the holding device, and the pivot joint provided by the bell-shaped housing and the swivel nut, there may be disposed a spacer or sleeve member.

The configuration of the clamp element which clamps the glass pane and which is provided at the exterior of the building can be in any manner; it can be provided in known manner as dish-type element or as countersunk screw, without affecting the stress-free fastening of the glass pane achieved in accordance with the teaching of that application.

In accordance with another aspect taught in that application, there is provided in a glass facade of a building having at least one glass pane, a clamping arrangement for holding the glass pane. The clamping arrangement includes a first clamp device that is configured to be disposed substantially stationary at a first side of the glass pane; a second clamp device disposed on the opposite side of the glass pane; the clamping arrangement being configured and disposed to retain the glass pane in clamped attitude. The clamping arrangement further includes a first angle adjustment arrangement configured and disposed to adjust an angle of the clamping arrangement; the first angle adjustment arrangement comprising a pivot joint arrangement configured to permit substantially multi-directional pivotal movement of the second clamp device to adjust and maintain the position of the glass pane securely relative to the building. The clamping arrangement is supported on the second side of the glass pane by the first pivot joint arrangement. The clamping arrangement also has a second angle adjustment arrangement configured and disposed to adjust another angle of the clamping arrangement. The second angle adjustment arrangement is connected in tandem with the first angle adjustment arrangement and includes a pivot joint arrangement configured to permit substantially multi-directional pivotal movement of at least a portion of the first angle adjustment arrangement relative to the building to thus adjust for irregularities of the glass pane and for irregularities in the building and to thus firmly hold the position of the glass pane relative to the building.

In accordance with yet another aspect taught in that application, there is provided a glass pane clamping arrangement for clamping a building glass pane in a facade of a building, the clamping arrangement includes a first clamp device, the first clamp device being disposed substantially stationary at a first side of the glass pane; a second clamp device disposed at a second side of the glass pane opposite the first side of the glass pane; the clamping arrangement being configured and disposed to retain the glass pane in clamped attitude. The clamping arrangement has a first angle adjustment arrangement configured and disposed to adjust an angle of the clamping arrangement; the first angle adjustment arrangement including a pivot joint arrangement configured to permit substantially multi-directional pivotal movement of the second clamp device to adjust and maintain the position of the glass pane securely relative to the building. The clamping arrangement is supported on the second side of the glass pane by the first pivot joint arrangement. The clamping arrangement further includes a second angle adjustment arrangement configured and disposed to adjust another angle of the clamping arrangement. The second angle adjustment arrangement is connected in tandem with the first angle adjustment arrangement to adjust for irregularities in the glass pane and for irregularities in the building to thus hold the glass pane firmly in the façade. The second angle adjustment arrangement comprises a pivot joint arrangement configured to permit substantially multi-directional pivotal movement of at least a portion of the first angle adjustment arrangement relative to the building to adjust for irregularities of the glass pane and for irregularities in the building and to thus firmly hold the position of the glass pane relative to the building.

Thus, that application provides a fastening assembly for a glass pane at a building-side holding device, in other words, at a building facade, which fastening assembly includes a clamping arrangement, which includes an exterior and an interior clamp device, and which clamping arrangement secures the glass pane in clamped position. The fastening assembly is supported at the interior clamp device by a pivot joint arrangement that provides an articulated support. The U.S. patent application Ser. No. 09/730,083 filed on Dec. 5, 2000 having attorney docket No. NHL-DOR-79, inventors Hubert ELMER et al. and entitled "Building Glass Façade of a Building, Clamping Arrangement in a Façade, and a Clamping Arrangement for Clamping a Building Glass Pane in a Façade", is hereby incorporated by reference as if set forth in its entirety herein.

The following foreign patents and patent applications, relating to glass mountings of the assignee herein and which comprise a clamp fitting of the type described above as part of the Applicant's own internal prior art, are hereby incorporated by reference as if set forth in their entirety herein: Federal Republic of Germany Patent No. 197 13 038.0, having inventor Ernst Udo BLÖBAUM, issued on Mar. 27, 1997 and entitled, "Klemmbeschlag für die Befestigung von Glasscheiben"; Federal Republic of Germany Patent No. 197 40 878, having inventor Herbert KORDES, issued on Sep. 17, 1997 and entitled, "Klemmbeschlag für die Befestigung von Glasscheiben"; Federal Republic of Germany Patent No. 199 15 478.3, having inventors Ernst Udo BLÖBAUM and Reinhard JANUTTA, issued on Apr. 7, 1999 and entitled, "Beschlag zur Halterung von Sicherheitsglasscheiben"; Federal Republic of Germany Patent No. 199 15 193.8, having inventor Hubert ELMER, issued on Apr. 6, 1999 and entitled, "Befestigungsvorrichtung für eine Glasplatte an eine gebäudeseitigen Halterung"; Federal Republic of Germany Patent Application No. 199 43 565.0, having inventor Hubert ELMER, filed on Sep. 13, 1999 and entitled, "Klemmbeschlag für die Eckverbinding von drei aneinander grenzenden Wänden"; Federal Republic of Germany Patent Application No. 199 38 571.8, having inventors Ralf KREYENBORG, Dirk SCHULTE, and Ernst Udo BLÖBAUM, filed on Aug. 17, 1999 and entitled, "Klemmbeschlag für die Befestigung von Glasscheiben"; Federal Republic of Germany Patent Application No. 199 39 172.6, having inventor Lothar GINZEL, filed on Aug. 20, 1999 and entitled, "Punktförmige Halterung für Isolierglasscheiben"; Federal Republic of Germany Patent Application No. 199 45 197.4, having inventor Hubert ELMER, filed on Aug. 20, 1999 and entitled "Befestigungsvorrichtung für eine Glasscheibe"; and Federal Republic of Germany Patent Application No. 199 45 196.6, having inventor Hubert ELMER, filed on Sep. 21, 1999 and entitled, "Befestigungsvorrichtung für eine Glasscheibe"; and Federal Republic of Germany Patent Application No. 101 01 517.8, having inventor Hubert ELMER, filed on Jan. 12, 2001, and entitled "Klemmbeschlag für die Befestigung von Glasscheiben".

Some examples of glass mountings or glass mounting devices which may possibly be used or adapted for use in at least one possible embodiment of the present invention may be found in the following U.S. Patents: U.S. Pat. No. 4,097,320, issued to inventors Brauer et al. on Jun. 27, 1978 and entitled "Method of manufacturing a double glass panel unit"; U.S. Pat. No. 4,841,697, issued to inventors Hogg et al. on Jun. 27, 1989 and entitled "Glass panel mounting assembly"; U.S. Pat. No. 5,212,922, issued to inventor Werner on May 25, 1993 and entitled "Kit for glass facades"; U.S. Pat. No. 5,283,978, issued to inventor Horgan, Jr. on Feb. 8, 1994 and entitled "Glass door and hinging mechanism with method of installation"; and U.S. Pat. No. 5,323,577, issued to inventor Whitmyer on Jun. 28, 1994 and entitled "Adjustable panel mounting clip". All of the foregoing patents are hereby incorporated by reference as if set forth in their entirety herein.

Some examples of facades and structures thereof which may possibly be used or adapted for use in at least one possible embodiment of the present invention, may be found in the following U.S. Patents: U.S. Pat. No. 5,373,672, issued to inventor Schulz on Dec. 20, 1994 and entitled "Arrangement of mounting sections for the fastening of a pane of glass"; U.S. Pat. No. 5,493,831, issued to inventor Jansson on Feb. 27, 1996 and entitled "Method and arrangement for securing glass facade elements"; U.S. Pat. No. 5,524,404, issued to inventor Lahaye on Jun. 11, 1996 and entitled "Facade structure"; U.S. Pat. No. 5,791,105, issued to inventor Gangi on Aug. 11, 1998 and entitled "Module for the production of an all-glass facade"; U.S. Pat. No. 5,802,799, issued to inventors Thuleskär et al. on Sep. 8, 1998 and entitled "Glazing system for buildings"; and U.S. Pat. No. 6,075,201, issued to inventor Wambach on Jun. 13, 2000 and entitled "Photovoltaic solar module in plate form". The aforementioned patents are hereby incorporated by reference as if set forth in their entirety herein.

Some examples of safety glass that may possibly be utilized or adapted for use in at least one possible embodiment of the present invention may be found in the following U.S. Patents: U.S. Pat. No. 4,632,877, issued to inventors Watanabe et al. on Dec. 30, 1986 and entitled "Laminated safety glass"; U.S. Pat. No. 4,663,228, issued to inventors Bolton et al. on May 5, 1987 and entitled "Laminates safety glass"; U.S. Pat. No. 4,668,574, issued to inventors Bolton et al. on May 26, 1987 and entitled "Laminated safety glass"; U.S. Pat. No. 5,002,820, issued to inventors Bolton et al. on Mar. 26, 1991 and entitled "Laminated safety glass"; U.S. Pat. No. 5,049,433, issued to inventor Leotta on Sep. 17, 1991 and entitled Architectural safety glass"; and U.S. Pat. No. 5,853,835, issued to inventor Leniton on Dec. 29, 1998 and entitled "Laminated and beveled safety glass panel". The aforementioned patents are hereby incorporated by reference as if set forth in their entirety herein.

Some examples of UV-stable adhesives for glass that may possibly be used or adapted for use in at least one possible embodiment of the present invention may be found in the following U.S. Patents: U.S. Pat. No. 6,191,199 B1, issued to inventors Renz et al. on Feb. 20, 2001 and entitled "Stabilized adhesive compositions"; and U.S. Pat. No. 6,201,055 B1, issued to inventors Lutz et al. on Mar. 13, 2001 and entitled "Silicone composition and silicone pressure sensitive adhesive". The aforementioned patents are hereby incorporated by reference as if set forth in their entirety herein.

Some examples of other adhesives for glass that may possibly be used or adapted for use in at least one possible embodiment of the present invention may be found in the following U.S. Patents: U.S. Pat. No. 5,075,382, issued to inventors Ohmae et al. on Dec. 24, 1991 and entitled "Adhesive for glass laminate"; and U.S. Pat. No. 5,102,937, issued to inventors Warren et al. on Apr. 7, 1992 and entitled "Glass adhesive". The aforementioned patents are hereby incorporated by reference as if set forth in their entirety herein.

Some examples of insulated or insulating glass that may possibly be utilized or adapted for use in at least one possible embodiment of the present invention may be found in the following U.S. Patents: U.S. Pat. No. 5,683,764, issued to inventor Alts on Nov. 4, 1997 and entitled "Insulating glass"; U.S. Pat. No. 5,705,010, issued to inventor Larsen on Jan. 6, 1998 and entitled "Multiple pane insulating glass unit with insulative spacer"; U.S. Pat. No. 6,014,872, issued to inventors Hartig et al. issued on Jan. 18, 2000 and entitled "Methods of making insulating glass units with neutral, high performance"; U.S. Pat. No. 6,038,825, issued to inventors Shah et al. on Mar. 21, 2000 and entitled "Insulated glass window spacer and method for making window spacer"; U.S. Pat. No. 6,059,909, issued to inventors Hartig et al. on May 9, 2000 and entitled "Neutral, high visible, durable low-e glass coating system"; and U.S. Pat. No. 6,138,433, issued to inventor Ridge on Oct. 31, 2000 and entitled "Insulated glass unit window assembly." The aforementioned patents are hereby incorporated by reference as if set forth in their entirety herein.

Some examples of insulating glass, insulated glass panes filled with an insulating gas other than air, and methods of filling glass panes with insulating gas that may be utilized or adapted for use in at least one possible embodiment of the present invention may be found in the following U.S. Patents: U.S. Pat. No. 5,626,712, issued to inventor Lisec on May 6, 1997 and entitled "Device for filling insulating glass panes with heavy gas"; U.S. Pat. No. 5,645,678, issued to inventor Lisec on Jul. 8, 1997 and entitled "Device for producing insulating glass panes"; U.S. Pat. No. 5,676,782, issued to inventor Lisec on Oct. 14, 1997 and entitled "Process for assembly of insulating glass panes"; U.S. Pat. No. 5,704,405, issued to inventor Lisec on Jan. 6, 1998 and entitled "Process and apparatus for filling insulating glass panes with heavy gas"; U.S. Pat. No. 5,762,739, issued to inventors Lenhardt et al. on Jun. 9, 1998 and entitled "Process and apparatus for assembling insulating glass panes"; and U.S. Pat. No. 5,957,169, issued to inventor Trpkovski on Sep. 28, 1999 and entitled "Apparatus and method for filling insulated glass units". The aforementioned patents are hereby incorporated by reference as if set forth in their entirety herein.

Some examples of plano-convex elements and spherical structures which may possibly be used or adapted for use in at least one possible embodiment of the present invention, may be found in the following U.S. Patents: U.S. Pat. No. 4,722,502, issued to inventors Mueller et al on Feb. 22, 1988 and entitled "Adjustable support system"; U.S. Pat. No. 4,780,000, issued to inventors Lewis et al. on Oct. 25, 1988 and entitled "Adjustable rod end"; U.S. Pat. No. 5,769,570, issued to inventors Stankus et al. on Jun. 23, 1998 and entitled "Cable tensioning dome plate"; U.S. Pat. No. 5,912,936, issued to inventors Charnley et al. on Jun. 15, 1999 and entitled "Pipe connector assembly"; U.S. Pat. No. 6,058,618, issued to inventors Hemmelgarn et al. on Mar. 9, 2000 and entitled "Coordinate measuring machine"; and U.S. Pat. No. 6,099,192, issued to inventor Free on Aug. 8, 2000 and entitled "Ball joint". The aforementioned patents are hereby incorporated by reference as if set forth in their entirety herein.

Some examples of elastic elements and compositions thereof which may be used with embodiments of the present invention, may be found in the following U.S. Patents: U.S. Pat. No. 4,649,685, issued to inventor Wolf et al. on Mar. 17, 1987 and entitled "Spacer"; U.S. Pat. No. 4,759,962, issued to inventors Buecken et al. on Jul. 26, 1988 and entitled "Elastomeric sealing gasket assembly and its method of manufacture"; and U.S. Pat. No. 4,837,996, issued to inventor Eckelt on Jun. 13, 1989 and entitled "Glass facade". The aforementioned patents are hereby incorporated by reference as if set forth in their entirety herein.

The features disclosed in the various publications, disclosed or incorporated by reference herein, may be used in the embodiments of the present invention, as well as, equivalents thereof.

One feature of the invention resides broadly in a building glass facade of a building comprising a plurality of glass elements covering at least a portion of the building, at least one of said elements comprising a glass pane, said facade comprising:

at least one glass pane 2;

said at least one glass pane 2 comprising a first surface, a second surface opposite from said first surface, and a hole connecting said first and second surfaces; and a clamp fitting 1 configured and disposed to secure said glass pane 2 to protect said glass pane 2 from thermal stresses, mechanical loads, and wind pressure;

said clamp fitting comprising:

a clamp assembly comprising a first clamp element 3 and a second clamp element 4;

said first clamp 3 element comprising a portion passing through said hole of said at least one glass pane 2;

said second clamp element 4 comprising a surface 6 facing away from said glass pane 2;

said first clamp element 3 and said second clamp element 4 being configured to secure said glass pane 2 in a clamped attitude;

a bell-shaped structure 11 comprising an interior surface 9;

an elastic element 7 disposed between said bell-shaped structure 11 and said second clamp element 4;

said elastic element 7 comprising a surface 8 of one of: a conical surface or a spherical surface 8;

said interior surface 9 of said bell-shaped structure 11 operatively contacting said surface 8 of said elastic element 7 to permit adjustable biasing of said bell-shaped structure 11;

a pivot arrangement 14 comprising a nut member 13, a bolt member 15, a first disc element 20 and a second disc element 21;

said nut member 13 operatively connecting said pivot arrangement 14 to said bell-shaped structure 11;

said nut member 13 comprising a base 17, and a passage 16 in said base 17;

said bolt member 15 comprising a shaft portion 28 extending through said passage 16;

said first disc element 20 comprising a first, planar, surface 22 and a second, concave, surface 19 opposite said first, planar, surface of said first disc element 20;

said first, planar, surface 22 of said first disc element 20 contacting said bell-shaped structure 11;

said second disc element 21 comprising a first, planar, surface 23 and a second, concave, surface 19 opposite from said first, planar, surface 23 of said second disc element 21;

said concave surface 19 of said first disc element 20 being disposed to face said concave surface 19 of said second disc element 21;

said first, planar, surface 23 of said second disc element 21 contacting said base 17 of said nut member 13;

a structure 31/24 comprising a first portion 31 having a first, convex surface 25 and a second, planar surface 29 opposite said convex surface 25, and said structure 31/24 comprising a second portion 24 having a first, convex surface 26 and a second, planar surface 30 opposite said second portion 24 convex surface 26;

said first portion 31 of said structure 31/24 being connected to said shaft portion 28 of said bolt member 15;

said first portion planar surface 29 and said second portion planar surface 30 being configured and disposed to permit sliding movement between said first portion and said second portions of said structure 31/24;

said first portion 31 convex surface 25 being configured to be slidingly disposed against said second, concave, surface 19 of said first disc element 20 to permit pivoting movement of said pivot arrangement 14 in at least two directions;

said second portion 24 convex surface 26 being configured to be slidingly disposed against said second, concave, surface 19 of said second disc element 21 to permit pivoting movement of said pivot arrangement 14 in at least two directions; and said clamp fitting 1 comprising:

a device 5 configured to connect said clamp fitting 1 to a support arrangement 60, 61, 62 connected to a building.

Another feature of the invention resides broadly in the building glass facade wherein:

said first concave disc element 20 is positioned with respect to said bell-shaped structure 11 to permit sliding movement of said first concave element 20 with respect to said bell-shaped structure 11;

said nut member 13 is configured and disposed to secure said pivot arrangement 14 to said bell-shaped structure 11;

said second concave disc element 21 is positioned with respect to said nut member 13 to permit sliding movement of said second concave disc element 21 with respect to said nut member 13.

Yet another feature of the invention resides broadly in the building glass facade wherein:

said device 5 comprises a fork with a hole therethrough to permit hinging movement of said clamp fitting 1 with respect to said support arrangement 60 which is connected to a building.

Still another feature of the invention resides broadly in the building glass facade wherein:

said elastic element 7 is disposed adjacent with respect to said second clamp element 4 to provide a biasing force with respect to said bell-shaped structure 11.

A further feature of the invention resides broadly in a building glass facade of a building comprising a plurality of glass elements covering at least a portion of the building, at least one of said elements comprising a glass pane, said facade comprising:

at least one glass pane 2;

said at least one glass pane 2 comprising a first surface, a second surface opposite from said first surface, and a hole connecting said first and second surfaces; and a clamp fitting 1 configured and disposed to secure said glass pane 2 to protect said glass pane 2 from thermal stresses, mechanical loads, and wind pressure;

said clamp fitting comprising:

a clamp assembly comprising a first clamp element 3 and a second clamp element 4;

said first clamp element 3 and said second clamp element 4 being configured to secure said glass pane 2 in a clamped attitude;

a bell-shaped structure 11;

a flexible structure 7 disposed between said bell-shaped structure 11 and said second clamp element 4 and configured to permit adjustable biasing of said bell-shaped structure 11;

a pivot arrangement 14 comprising a bolt member 15, a nut member 13, first and second disc elements 20, 21, and a structure 31/24 configured and disposed to permit pivoting movement of said pivot arrangement 14;

said first disc element 20 comprising a concave surface 19;

said second disc element 21 comprising a concave surface 19;

said pivot structure 31/24 comprising a first portion 31 comprising a convex surface 25;

said pivot structure 31/24 comprising a second portion 24 comprising a convex surface 26;

said first 31 and second 24 portions being configured and disposed to be in contact with one another to permit movement in at least two directions of said pivot arrangement 14;

said pivot structure second portion 24 being connected to said bolt member 15;

said convex surface 25 of said pivot structure 31/24 first portion 31 being configured to be slidingly disposed against said concave surface 19 of said first disc element 20 to permit movement in at least two directions of said pivot arrangement 14, and said convex surface 26 of said pivot structure 31/24 second portion 24 being configured to be slidingly disposed against said concave surface 19 of said second disc element 21 to permit movement in at least two directions of said pivot arrangement 14; and said clamp fitting 1 comprising:

a device 5 configured to connect said clamp fitting 1 to a support arrangement 60, 61, 62 connected to a building.

Another feature of the invention resides broadly in the building glass facade wherein:

said first convex portion 31 comprises a planar surface 29 disposed away from said clamp assembly 3,4;

said second convex portion 24 comprises a planar surface 30 disposed towards said planar surface 30 of said first convex portion 31;

said planar surfaces 29, 30 being configured to permit sliding movement of said first convex portion 31 and said second convex portion 24 with respect to one another.

Yet another feature of the invention resides broadly in the building glass facade wherein:

said first concave element 20 is positioned with respect to said bell-shaped structure 11 to permit sliding movement of said first concave element 20 with respect to said bell-shaped structure 11;

said nut member 13 is configured to secure said pivot arrangement 14 to said bell-shaped structure 11;

said second concave element 21 is positioned with respect to said nut member 13 to permit sliding movement of said second concave element 21 with respect to said nut member 13.

Still another feature of the invention resides broadly in the building glass facade wherein:

said device 5 comprises a fork with a hole therethrough to permit hinging movement of said clamp fitting 1 with respect to said support arrangement 60 which is connected to a building.

A further feature of the invention resides broadly in a clamp fitting 1 configured to secure a glass plate 2 to a building, said clamp fitting 1 comprising:

a clamp assembly 3,4 configured to secure a glass plate 2 in clamped attitude at a predetermined distance adjacent to a building;

a first articulated arrangement 35 operatively connected to said clamp assembly 3,4; said first articulated arrangement 35 comprising a flexible element 7 configured to compensate for thermal stresses, mechanical loads, and wind pressure impacting on a glass plate 2 secured by said clamp assembly 3,4;

a second articulated arrangement 14 operatively connected to said first articulated arrangement 35;

said second articulated arrangement 14 comprising a first concave element 20, and a second concave element 21;

each of said first 20 and second 21 concave elements comprising a concave surface 19;

said concave surface 19 of said first concave element 20 being disposed towards said concave surface 19 of said second concave element 21;

said second articulated arrangement comprising a first convex portion 31 disposed towards said first articulated arrangement 35, and also comprising a second convex portion 24 disposed away from said first convex portion 31;

said second articulated arrangement 14 comprising a structure 15 being connected to said first convex portion 31; and fastener means 5, 61, 62 configured to secure said structure 15 to a support 60 connected to a building structure;

said fastener means being connected to said structure;

said first convex portion 31 being configured to slide against said concave surface 19 of said first concave element 20, and said second convex portion 24 being configured to slide against said concave surface 19 of said second concave element 21; to permit pivoting movement of said clamp assembly 3,4 with respect to a building.

Another feature of the invention resides broadly in the clamp fitting 1 wherein:

said first convex portion 31 comprises a planar surface 29 disposed away from said first articulated arrangement 35;

said second convex portion 24 comprises a planar surface 30 disposed towards said planar surface 30 of said first convex portion 31;

said planar surfaces 29, 30 being configured to permit sliding movement of said first convex portion 31 and said second convex portion 24 with respect to one another.

Yet another feature of the invention resides broadly in the clamp fitting wherein:

said first articulated arrangement comprises a bell-shaped structure 11;

said first concave element 20 being positioned with respect to said bell-shaped structure 11 to permit sliding movement of said first concave element 20 with respect to said bell-shaped structure 11;

said second articulated arrangement 14 comprises a nut member 13 to secure said second articulated arrangement 14 to said bell-shaped structure 11 and said first articulated arrangement 35;

said second concave element 21 being positioned with respect to said nut member 13 to permit sliding movement of said second concave element 21 with respect to said nut member 13.

Still another feature of the invention resides broadly in the clamp fitting wherein:

said structure 15 comprises a bolt member 15;

said fastener means 5, 61, 62 comprises an interiorly threaded connection element 5 threaded onto said bolt member 15.

A further feature of the invention resides broadly in the clamp fitting wherein:

said connection element 5 comprises a fork with a hole therethrough to permit hinging movement of said clamp fitting 1 with respect to said support 60 which is connected to a building.

Another feature of the invention resides broadly in the clamp fitting wherein:

said bell-shaped structure 11 comprises an inner surface portion;

said inner surface portion being substantially conical.

Yet another feature of the invention resides broadly in the clamp fitting wherein:

said bell-shaped structure 11 comprises an inner surface portion;

said inner surface portion being substantially spherical.

Still another feature of the invention resides broadly in the clamp fitting wherein:

said bell-shaped structure 11 comprises an extension;

said extension is cylindrical, is externally threaded, and is disposed away from a glass plate 2;

said nut member 13 operatively engaging said threaded cylindrical extension of said bell-shaped structure 11.

A further feature of the invention resides broadly in the clamp fitting wherein:

said clamp assembly comprises a first clamp element 3 and a second clamp element 4;

said bell-shaped structure 11 substantially enclosing said flexible element 7;

said flexible element 7 being disposed adjacent with respect to said second clamp element to provide a biasing force with respect to said bell-shaped structure 11.

Another feature of the invention resides broadly in the clamp fitting wherein:

said first articulated arrangement 35 comprising a screw member 34 and also comprising a lens element 37 having at least one convex surface;

said screw member 34 is positioned with respect to said lens element 37 to effectuate securement of said bell-shaped structure 11 to said second clamp element 4;

said convex lens element 37 is positioned with respect to said bell-shaped structure 11 to effectuate positioning of said bell-shaped structure 11 in a first chosen orientation relative to said second clamp element 4;

said elastic element 7 being disposed to permit resilient perturbation of said bell-shaped structure 11 from said first chosen orientation relative to said second clamp element 4.

Yet another feature of the invention resides broadly in the clamp fitting wherein:

said convex lens element 37 comprises a plano-convex lens element.

A further feature of the invention resides broadly in the clamp fitting wherein:

said nut member 13 is configured to secure said bolt member 15 and said second articulated arrangement 14 in a second chosen orientation relative to a building.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

LIST OF REFERENCE SYMBOLS

1 Clamp fitting
2 Glass plate
3 Clamp element
4 Clamp element
5 Articulated connection
6 Lateral surface
7 Substantially permanently elastic spring element
8 Lateral surface
9 Complementary surface
10 Inner lateral surface
11 Clamping bell
12 Cylindrical extension
13 Union nut
14 Three-dimensionally articulated hinge
15 Pendulum bolt
16 Opening
17 Cup base
18 Clearance
19 Spherical surfaces
20 Plano-concave lens
21 Plano-concave lens
22 Plane surface
23 Plane surface
24 Bolt head
25 Complementary surface
26 Complementary surface
27 Longitudinal axis
28 Bolt shank
29 Plane surface
30 Plane surface
31 Plano-convex lens
32 Clearance
33 Male thread
34 Clamping bell set screw
35 Three-dimensionally articulated hinge
36 Bolt head
37 Plano convex lens
41 Clamp fitting having spherical clamping bell
47 Spherical substantially permanently elastic spring member
48 Lateral surface of spring member
49 Complementary surface of spherical clamping bell
50 Inner lateral surface of spherical clamping bell
51 Spherical clamping bell
60 Structure or member connected to building
61 Bolt
62 Nut
63 Washer
B Building
F Facade

What is claimed is:

1. A building glass facade of a building comprising a plurality of glass elements covering at least a portion of the building, at least one of said elements comprising a glass pane, said facade comprising:

at least one glass pane;

said at least one glass pane comprising a first surface, a second surface opposite from said first surface, and a hole connecting said first and second surfaces; and a clamp fitting configured and disposed to secure said glass pane to protect said glass pane from thermal stresses, mechanical loads, and wind pressure;

said clamp fitting comprising:

a clamp assembly comprising a first clamp element and a second clamp element;

said first clamp element comprising a portion passing through said hole of said at least one glass pane;

said second clamp element comprising a surface facing away from said glass pane;

said first clamp element and said second clamp element being configured to secure said glass pane in a clamped attitude;

a bell-shaped structure comprising an interior surface;

an elastic element disposed between said bell-shaped structure and said second clamp element;

said elastic element comprising a surface of one of: a conical surface or a spherical surface;

said interior surface of said bell-shaped structure operatively contacting said surface of said elastic element to permit adjustable biasing of said bell-shaped structure;

a pivot arrangement comprising a nut member, a bolt member, a first disc element and a second disc element;

said nut member operatively connecting said pivot arrangement to said bell-shaped structure;

said nut member comprising a base, and a passage in said base;

said bolt member comprising a shaft portion extending through said passage;

said first disc element comprising a first, planar, surface and a second, concave, surface opposite said first, planar, surface of said first disc element;

said first, planar, surface of said first disc element contacting said bell-shaped structure;

said second disc element comprising a first, planar, surface and a second, concave, surface opposite from said first, planar, surface of said second disc element;

said concave surface of said first disc element being disposed to face said concave surface of said second disc element;

said first, planar, surface of said second disc element contacting said base of said nut member;

a structure comprising a first portion having a first, convex surface and a second, planar surface opposite said convex surface, and said structure comprising a second portion having a first, convex surface and a second, planar surface opposite said second portion convex surface;

said first portion of said structure being connected to said shaft portion of said bolt member;

said first portion planar surface and said second portion planar surface being configured and disposed to permit sliding movement between said first portion and said second portions of said structure;

said first portion convex surface being configured to be slidingly disposed against said second, concave, surface of said first disc element to permit pivoting movement of said pivot arrangement in at least two directions;

said second portion convex surface being configured to be slidingly disposed against said second, concave, surface of said second disc element to permit pivoting movement of said pivot arrangement in at least two directions; and said clamp fitting comprising:

a device configured to connect said clamp fitting to a support arrangement connected to a building.

2. The building glass facade according to claim 1, wherein:

said first concave disc element is positioned with respect to said bell-shaped structure to permit sliding movement of said first concave element with respect to said bell-shaped structure;

said nut member is configured and disposed to secure said pivot arrangement to said bell-shaped structure;

said second concave disc element is positioned with respect to said nut member to permit sliding movement of said second concave disc element with respect to said nut member.

3. The building glass facade according to claim 2, wherein:

said device comprises a fork with a hole therethrough to permit hinging movement of said clamp fitting with respect to said support arrangement which is connected to a building.

4. The building glass facade according to claim 3, wherein:

said elastic element is disposed adjacent with respect to said second clamp element to provide a biasing force with respect to said bell-shaped structure.

5. A building glass facade of a building comprising a plurality of glass elements covering at least a portion of the building, at least one of said elements comprising a glass pane, said facade comprising:

at least one glass pane;

said at least one glass pane comprising a first surface, a second surface opposite from said first surface, and a hole connecting said first and second surfaces; and a clamp fitting configured and disposed to secure said glass pane to protect said glass pane from thermal stresses, mechanical loads, and wind pressure;

said clamp fitting comprising:

a clamp assembly comprising a first clamp element and a second clamp element;

said first clamp element and said second clamp element being configured to secure said glass pane in a clamped attitude;

a bell-shaped structure;

a flexible structure disposed between said bell-shaped structure and said second clamp element and configured to permit adjustable biasing of said bell-shaped structure;

a pivot arrangement comprising a bolt member, a nut member, first and second disc elements, and a structure configured and disposed to permit pivoting movement of said pivot arrangement;

said first disc element comprising a concave surface;

said second disc element comprising a concave surface;

said pivot structure comprising a first portion comprising a convex surface;

said pivot structure comprising a second portion comprising a convex surface;

said first and second portions being configured and disposed to be in contact with one another to permit movement in at least two directions of said pivot arrangement;

said pivot structure second portion being connected to said bolt member;

said convex surface of said pivot structure first portion being configured to be slidingly disposed against said concave surface of said first disc element to permit movement in at least two directions of said pivot arrangement, and said convex surface of said pivot structure second portion being configured to be slidingly disposed against said concave surface of said second disc element to permit movement in at least two directions of said pivot arrangement; and said clamp fitting comprising:

a device configured to connect said clamp fitting to a support arrangement connected to a building.

6. The building glass facade according to claim 5, wherein:

said first convex portion comprises a planar surface disposed away from said clamp assembly;

said second convex portion comprises a planar surface disposed towards said planar surface of said first convex portion;

said planar surfaces being configured to permit sliding movement of said first convex portion and said second convex portion with respect to one another.

7. The building glass facade according to claim 6, wherein:

said first concave element is positioned with respect to said bell-shaped structure to permit sliding movement of said first concave element with respect to said bell-shaped structure;

said nut member is configured to secure said pivot arrangement to said bell-shaped structure;

said second concave element is positioned with respect to said nut member to permit sliding movement of said second concave element with respect to said nut member.

8. The building glass facade according to claim 6, wherein:

said device comprises a fork with a hole therethrough to permit hinging movement of said clamp fitting with respect to said support arrangement which is connected to a building.

9. A clamp fitting configured to secure a glass plate to a building, said clamp fitting comprising:

a clamp assembly configured to secure a glass plate in clamped attitude at a predetermined distance adjacent to a building;

a first articulated arrangement operatively connected to said clamp assembly;

said first articulated arrangement comprising a flexible element configured to compensate for thermal stresses, mechanical loads, and wind pressure impacting on a glass plate secured by said clamp assembly;

a second articulated arrangement operatively connected to said first articulated arrangement;

said second articulated arrangement comprising a first concave element, and a second concave element;

each of said first and second concave elements comprising a concave surface;

said concave surface of said first concave element being disposed towards said concave surface of said second concave element;

said second articulated arrangement comprising a first convex portion disposed towards said first articulated arrangement, and also comprising a second convex portion disposed away from said first convex portion;

said second articulated arrangement comprising a structure being connected to said first convex portion; and fastener means configured to secure said structure to a support connected to a building structure;

said fastener means being connected to said structure;

said first convex portion being configured to slide against said concave surface of said first concave element, and said second convex portion being configured to slide against said concave surface of said second concave element; to permit pivoting movement of said clamp assembly with respect to a building.

10. The clamp fitting according to claim 9, wherein:

said first convex portion comprises a planar surface disposed away from said first articulated arrangement;

said second convex portion comprises a planar surface disposed towards said planar surface of said first convex portion;

said planar surfaces being configured to permit sliding movement of said first convex portion and said second convex portion with respect to one another.

11. The clamp fitting according to claim 10, wherein:

said first articulated arrangement comprises a bell-shaped structure;

said first concave element being positioned with respect to said bell-shaped structure to permit sliding movement of said first concave element with respect to said bell-shaped structure;

said second articulated arrangement comprises a nut member to secure said second articulated arrangement to said bell-shaped structure and said first articulated arrangement;

said second concave element being positioned with respect to said nut member to permit sliding movement of said second concave element with respect to said nut member.

12. The clamp fitting according to claim 11, wherein:

said structure comprises a bolt member;

said fastener means comprises an interiorly threaded connection element threaded onto said bolt member.

13. The clamp fitting according to claim 12, wherein:

said connection element comprises a fork with a hole therethrough to permit hinging movement of said clamp fitting with respect to said support which is connected to a building.

14. The clamp fitting according to claim 13, wherein:

said bell-shaped structure comprises an inner surface portion;

said inner surface portion being substantially conical.

15. The clamp fitting according to claim 13, wherein:

said bell-shaped structure comprises an inner surface portion;

said inner surface portion being substantially spherical.

16. The clamp fitting according to claim 14, wherein:

said bell-shaped structure comprises an extension;

said extension is cylindrical, is externally threaded, and is disposed away from a glass plate;

said nut member operatively engaging said threaded cylindrical extension of said bell-shaped structure.

17. The clamp fitting according to claim 16, wherein:

said clamp assembly comprises a first clamp element and a second clamp element;

said bell-shaped structure substantially enclosing said flexible element;

said flexible element being disposed adjacent with respect to said second clamp element to provide a biasing force with respect to said bell-shaped structure.

18. The clamp fitting according to claim 17, wherein:

said first articulated arrangement comprising a screw member and also comprising a lens element having at least one convex surface;

said screw member is positioned with respect to said lens element to effectuate securement of said bell-shaped structure to said second clamp element;

said convex lens element is positioned with respect to said bell-shaped structure to effectuate positioning of said bell-shaped structure in a first chosen orientation relative to said second clamp element;

said elastic element being disposed to permit resilient perturbation of said bell-shaped structure from said first chosen orientation relative to said second clamp element.

19. The clamp fitting according to claim 18, wherein:

said convex lens element comprises a plano-convex lens element.

20. The clamp fitting according to claim 19, wherein:

said nut member is configured to secure said bolt member and said second articulated arrangement in a second chosen orientation relative to a building.

* * * * *